US007331396B2

(12) United States Patent
Reimert et al.

(10) Patent No.: US 7,331,396 B2
(45) Date of Patent: Feb. 19, 2008

(54) SUBSEA PRODUCTION SYSTEMS

(75) Inventors: Larry E. Reimert, Houston, TX (US); Lionel J. Milberger, Wheelock, TX (US)

(73) Assignee: Dril-Quip, Inc., Houston, TX (US)

( * ) Notice: Subject to any disclaimer, the term of this patent is extended or adjusted under 35 U.S.C. 154(b) by 275 days.

(21) Appl. No.: 11/076,786

(22) Filed: Mar. 10, 2005

(65) Prior Publication Data

US 2005/0205262 A1 Sep. 22, 2005

Related U.S. Application Data

(60) Provisional application No. 60/553,669, filed on Mar. 16, 2004.

(51) Int. Cl.
*E21B 33/043* (2006.01)

(52) U.S. Cl. ..... 166/368; 166/97.1; 166/97.5; 166/319; 166/320; 166/321

(58) Field of Classification Search ..... 166/133, 166/188, 321, 319, 320, 368, 335, 97.5, 348, 166/97.1
See application file for complete search history.

(56) References Cited

U.S. PATENT DOCUMENTS 4,632,188 A * 12/1986 Schuh et al. ..... 166/368
5,544,707 A 8/1996 Hopper et al. ..... 166/382
5,941,310 A * 8/1999 Cunningham et al. ..... 166/345
6,039,119 A 3/2000 Hopper et al. ..... 166/368
6,516,876 B1 * 2/2003 Jennings ..... 166/348
6,547,008 B1 4/2003 Hopper et al. ..... 166/348
6,866,095 B2 * 3/2005 Skeels ..... 166/321
6,991,039 B2 1/2006 Hopper et al. ..... 166/348
7,093,660 B2 8/2006 Hopper et al. ..... 166/348
7,117,945 B2 10/2006 Hopper et al. ..... 166/348
2001/0011593 A1 * 8/2001 Wilkins ..... 166/368
2003/0006042 A1 1/2003 DeBerry ..... 166/368

FOREIGN PATENT DOCUMENTS

GB 2 291 085 1/1996

OTHER PUBLICATIONS

UK Search Report.

* cited by examiner

*Primary Examiner*—Lanna Mai
*Assistant Examiner*—Matthew J. Smith
(74) *Attorney, Agent, or Firm*—Paul R. Morico; Baker Botts L.L.P.

(57) ABSTRACT

A subsea production system is disclosed. The subsea production system may comprise a well head, a tubing spool, a tubing hanger, an annulus, a production tree, and a bypass flow path.

31 Claims, 22 Drawing Sheets

SUBSEA PRODUCTION SYSTEMS

PRIORITY

This application claims priority to and is a conversion of U.S. Provisional Application Ser. No. 60/553,669 filed Mar. 16, 2004.

BACKGROUND

The present invention relates generally to subsea production systems, and more particularly to subsea production systems having a bypass flow path from a point below a tubing hanger to a point above a tubing hanger.

Some subsea production systems have a wellhead located at the upper end of a well. The wellhead typically suspends one or more casing strings. Connected to the top of the wellhead is a tubing spool. A tubing hanger typically lands in the tubing spool, and the tubing hanger suspends a tubing string through the wellhead into the casing string. A conventional production tree can be connected to the top of the tubing spool. Conventional production trees include vertical and horizontal trees. Horizontal trees can be incorporated as part of the spool system. Vertical trees typically have a vertical passageway that receives an upward flow of product from the tubing hanger and a vertical passageway that receives an upward flow of annular fluid. Horizontal trees typically include a passageway that receives a vertical flow of product and one or more lateral passageways for delivering product and possibly annular fluid.

Production trees may include single or dual bore systems. A dual bore system permits the use of a production bore and a tubing annulus bore. Horizontal production trees typically have a production bore and a large diameter tubing hanger. Large diameter bores are difficult to seal in the presence of a high pressure, which results in large upthrust forces. To alleviate some of the problems associated with large diameter wells, wells have been drilled in two stages using a two stack system. For example, wells may be drilled with stacks having sizes of 18.75 inches and 13.625 inches. Vertical trees may also be used, but they typically include a top terminated annulus. Vertical production trees may be used to reduce the diameter of the tubing hanger. However, a reduction in the diameter of the tubing hanger reduces the diameter of tools that may enter the production system without removing the tree. Conventional production trees generally are not well suited for high pressure production systems having small spool and/or wellhead diameters.

During production it may be desirable to remove a production tree and replace it with a blow out preventer ("BOP") and safely perform work over tasks. Alternatively, a BOP stack located on top of a tree may be used to work over a well. A BOP stack, however, typically exerts a large bending load to points at and below the point of connection of the BOP stack with the production system. Removing a conventional tree can be a time and labor consuming task that involves some risk of well destruction.

SUMMARY

The present invention is generally directed to a subsea production system, which includes a wellhead, a casing string suspended from the wellhead a tubing spool having a central bore connected to the wellhead, a tubing hanger disposed within the tubing spool and sealed thereto, a tubing string suspended from the tubing hanger through the wellhead into the casing string, an annulus disposed between the tubing string and the casing string, and a bypass annulus fluid flow path in fluid communication with the annulus. The subsea production system further includes a production tree connected to the tubing spool, which includes a production flow path that has a production master valve, a production wing valve and a production swab valve for controlling flow through the production flow path.

In one embodiment of the present invention, the bypass annulus fluid flow path passes through a separate annulus block. In this embodiment, the bypass annulus fluid flow path has a first end which is in fluid communication with the annulus and a second end which is in fluid communication with the central bore of the tubing spool above the tubing hanger. The bypass annulus fluid flow path further includes an annulus master valve and an annulus wing valve connected in series with the annulus master valve, which control flow into an annular flow line, which in turn connects with a subsea fluid flow system. The bypass annulus fluid flow path further includes a cross over valve connected in parallel with the annulus wing valve and which connects to an annular flow line that communicates with the production flow path in the production tree connected to the tubing spool. In an alternate form of this embodiment, the cross over valve controls flow to the BOP stack jumper, which in turn communicates with a central bore of a BOP. The bypass annulus fluid flow path may further include a work over valve connected in parallel with the annulus wing valve that controls flow into a central bore of the tubing spool.

In another embodiment of the present invention, the bypass annulus fluid flow path is integrated into the spool. In this embodiment, the bypass annulus fluid flow path includes a first end which is in fluid communication with the annulus and a second end which is in fluid communication with the central bore of the tubing spool above the tubing hanger. The bypass annulus fluid flow path further includes an annulus master valve and an annulus wing valve connected in series with the annulus master valve, which control flow into an annular flow line. The bypass annulus fluid flow path further includes a cross over valve connected in parallel with the annulus wing valve and which connects to an annular flow line that communicates with a central bore of the production tree. The bypass annulus fluid flow path further includes a work over valve connected in parallel with the annulus wing valve that communicates with a central bore of the tubing spool. In another form of this embodiment, the cross over valve connects the central bore of the tubing spool to a central bore of the production tree.

In another embodiment, the bypass annulus fluid flow path includes a first end which is in fluid communication with the annulus, a second end which is in fluid communication with the production flow path of the production tree, an annulus master valve and an annulus wing valve connected in series with the annulus master valve, which control flow into an annular flow line. In this embodiment, the subsea system further includes an annulus stab connected in parallel with the annulus wing valve and a cross over valve connected in series with the annulus stab, which controls flow into the production flow path.

In yet another embodiment, the bypass annulus fluid flow path passes through an annulus tree. In this embodiment, the bypass annulus fluid flow path includes a first end which is in fluid communication with the annulus and a second end which is in fluid communication with the central bore of the tubing spool above the tubing hanger. In this embodiment, the bypass annulus fluid flow path also includes an annulus master valve and an annulus wing valve connected in series with the annulus master valve, which control flow into an annular flow line. The bypass annulus fluid flow path further includes a work over valve connected in parallel with the annulus wing valve which controls flow into the central bore of the tubing spool. The subsea system according to present invention further includes a fluid line that connects the bypass annulus fluid flow path to the production flow path of the production tree and a cross over valve connected in parallel with the work over valve and disposed within said fluid line. In this embodiment, the cross over valve is disposed in the annulus tree. In another embodiment, the cross over valve is disposed in the production tree. In another embodiment, the subsea production system further includes a flow path connecting the central bore of the tubing spool to the production flow path in the production tree and a cross over valve disposed in the flow path connecting the central bore of the tubing spool and the production flow path in the production tree. In yet another embodiment of the present invention, the subsea production system further includes a work over valve connected in series with the annulus master valve that controls flow into the central bore of the tubing spool and a cross over valve connected in parallel with the annulus master valve, which connects flow to production flow path of the production tree. In still another embodiment, the subsea production system further includes a cross over valve connected in parallel with the annulus wing valve which controls flow into the production flow path of the production tree connected to the tubing spool and which is disposed within the production tree. In another embodiment, the subsea production system includes a cross over valve disposed within the annulus tree. The cross over valve in this embodiment is connected in parallel with the annulus wing valve and controls flow into the production flow path of the production tree.

BRIEF DESCRIPTION OF THE DRAWINGS

A more complete understanding of the present disclosure and advantages thereof may be acquired by referring to the following description taken in conjunction with the accompanying drawings wherein.

Figure 1:
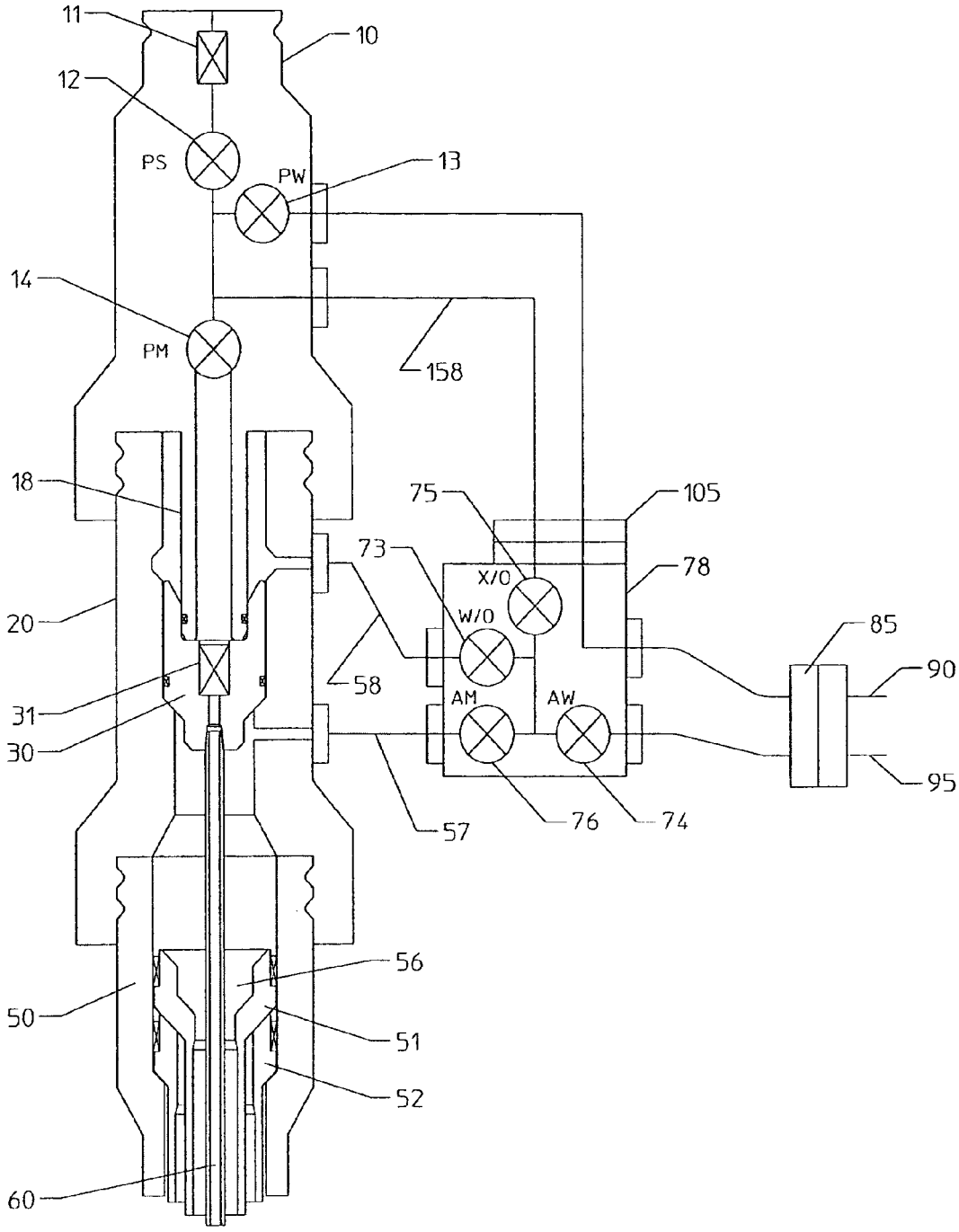
FIG. 1 is an example of a subsea production system having a separate annulus block according to the present invention.

The present invention may be susceptible to various modifications and alternative forms. Specific embodiments of the present invention are shown by way of example in the drawings and are described herein in detail. It should be understood, however, that the description set forth herein of specific embodiments is not intended to limit the present invention to the particular forms disclosed. Rather, all modifications, alternatives and equivalents falling within the spirit and scope of the invention as defined by the appended claims are intended to be covered.

DETAILED DESCRIPTION

The details of the present invention will now be described with reference to the figures. Turning to FIG. 1, one example of a subsea production system is depicted. FIG. 1 includes a production tree 10, a spool 20, a tubing hanger 30, and a wellhead 50, and annulus block 78.

Production tree 10 shown in FIG. 1 includes production tree plug 11, production swab ("PS") valve 12, production wing ("PW") valve 13 and production master ("PM") valve 14. Production master valve 14 may be coupled to the bore of production tree 10. The bore of production tree 10 is coupled to tubing hanger 30. In the example shown in FIG. 1, an isolation sleeve 18 seals production tree 10 to tubing hanger 30. The production tree 10 can seal to the spool 20 using seals not shown. Tubing hanger 30 includes tubing hanger plug 31. The tubing hanger 30 may land in the bore of spool 20. The tubing hanger 30 may be sealed to spool 20. Spool 20 connects and seals to wellhead 50. Conventional seals (not shown) may seal the spool to the wellhead. Tubing hanger 30 may suspend a tubing string 60 into and through wellhead 50. Wellhead 50 may suspend inner casing string from hanger 51 and outer casing string from hanger 52. Tubing string 60 may be suspended into casing string suspended from hanger 51.

In one example, the wellhead may be an 18.75 inch wellhead system. In one example, spool 20 may include an upper and lower bore. In one example, wellhead 50 may suspend one casing string. In another embodiment, wellhead 50 may suspend two or more casing strings.

Production wing valve 13 in the example shown in FIG. 1 is connected to production flow line 90 through production jumper connector 105. During production, the production flow travels through tubing string 60, through tubing hanger 30, through production tree 10, through PM valve 14, through PW valve 13 and out through production flow line 90. Production flow line 90 and annular flow line 95 are connected to flow line connector 85. In one example, production flow line 90 exits laterally from production tree 10. Because a top terminated annulus bore in the production tree is not required, a smaller, lighter, and more economical tree may be used.

The region between tubing string 60 and the inner most casing string suspended from casing hanger 51, forms an annular region 56. Some of the embodiments of the present invention separate some or all the annulus flow regions into an annulus block from which annular flow may be controlled. The annular fluid flow within annular region in the embodiment depicted in FIG. 1 flows through annulus region 56 into the annular region of spool 20. The annular fluid flow may be coupled to a bypass annulus flow path. Bypass annulus fluid flow path includes flow path 57 which is in fluid communication with annulus block 78. In the example shown in FIG. 1, annulus block 78 includes cross over valve ("X/O") 75, work over valve ("W/O") 73, annulus master valve ("AM") 76, and annulus wing valve ("AW") 74. Assuming both X/O valve 75 and annulus AW valve 74 are in the closed position, and both AM valve 76 and W/O valve 73 are in the open position, annulus bypass flow path also includes flow path 58 which connects the annular fluid flow to the central bore of the tubing spool above the tubing hanger. The example shown in FIG. 1 includes a bypass fluid path having an upper and a lower end. The lower end of the bypass flow path may communicate with the tubing annular region below the tubing hanger. The upper end of the bypass flow path may communicate with the central bore of the tubing spool above the tubing hanger.

The annular wing valve 74 in annulus block 78 controls the annular fluid that flows through annulus flow line 95. For example, if both X/O valve 75 and W/O valve 73 are in the closed position, and if both AM valve 76 and AW valve 74 are in the open position, annulus fluid may flow through annular region 56, through annulus flow path 57, through valves AM 76 and AW 74, and through flow line connector 85 into annular flow line 95. Similarly, access to the annular fluid may be provided through annular flow line 95.

Cross over valve 75 provides additional functionality in the subsea production system. For example, closing valves PW 13 and PS 12 permits the product to flow through PM valve 14 and through cross over line 158. Further, if both valves W/O 73 and AM 76 are in the closed position and both valves X/O 75 and AW 74 are in the open position, product may flow through annulus flow line 95.

Production tree 10 may be removed and replaced with a blow out preventer ("BOP") during work over. For example, X/O valve 75 and production tree hanger plug 31 may be placed in their respective closed and installed positions, and production tree 10 may be removed from spool 20. A BOP may then be connected to spool 20. With a BOP in place, and W/O valve 73, AM valve 76, and AW valve 74 in their respective closed positions, surface access to the annulus fluid is thereby provided through the BOP choke and kill lines. By placing the annular valves on a base, the annulus fluid may be accessed from an annulus block 78 mounted on a base.

In one embodiment of the present invention, a BOP may be connected directly to the tubing spool 20. For example, the tubing hanger plug 31, and valves AM 76 and W/O 73 may be closed. If a parking stump is included in the subsea production system, the production tree may then be taken off the spool and placed on a parking stump. A BOP may then be connected to the spool. One skilled in the art with the benefit of this disclosure will recognize other valves that may be closed during BOP connection.

Some embodiments of the present invention permit the minimization of the number of valves in a production tree. Additionally, subsea production systems according to the present invention may lack a horizontal outlet from spool 20 and from tubing hanger 30. In some examples, the production tree does not have an annulus bore that traverses through the production tree. Other embodiments of the present invention may provide one or more of the following advantages:

No need for a work over/test tree;

Permanent vertical flow line connection may be used;

A tree may be pulled without pulling tubing;

Tubing may be pulled without pulling the tree (e.g., a tree may be on a parking stump);

All production valves may be retrievable;

Slim line wells may be compatible;

HPHT wells may be compatible;

Slim line stacks may be compatible;

Surface stack floater rigs may be compatible;

Slim bore risers may be compatible;

Single bore riser may be used; and

Completion may be run without the control POD or FLC in place.

Figure 2:
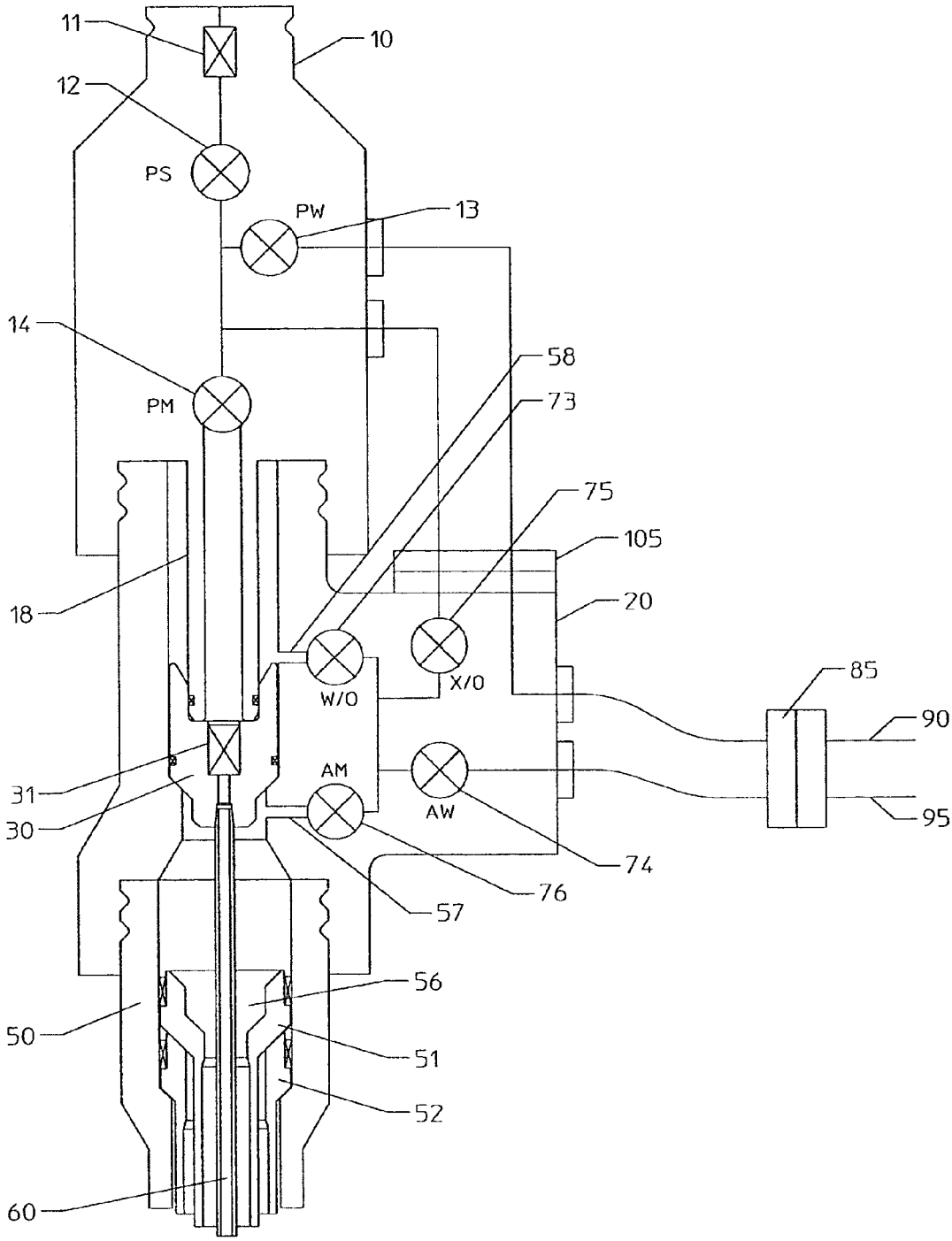
FIG. 2 is an example of a subsea production system having integral annulus valves according to the present invention.

The present invention may be implemented in various embodiments. FIG. 2 depicts an implementation having a spool with integral annulus valves. Controlling annulus valves W/O 73, AM 76, AW 74, and X/O 75 in spool 20 of FIG. 2 may control annular flow. For example, closing valves W/O 73 and X/O 75 and opening valves AM 76 and AW 74 permits annular flow through annulus 56 through bypass flow path 57 and out through annulus flow line 95. In another embodiment, production tree 10 of FIG. 2 may be replaced by a BOP, and annulus flow may occur through flow lines 57 and 58. One skilled in the art with the benefit of this disclosure will recognize other ways to implement and operate a subsea production system.

Figure 3:
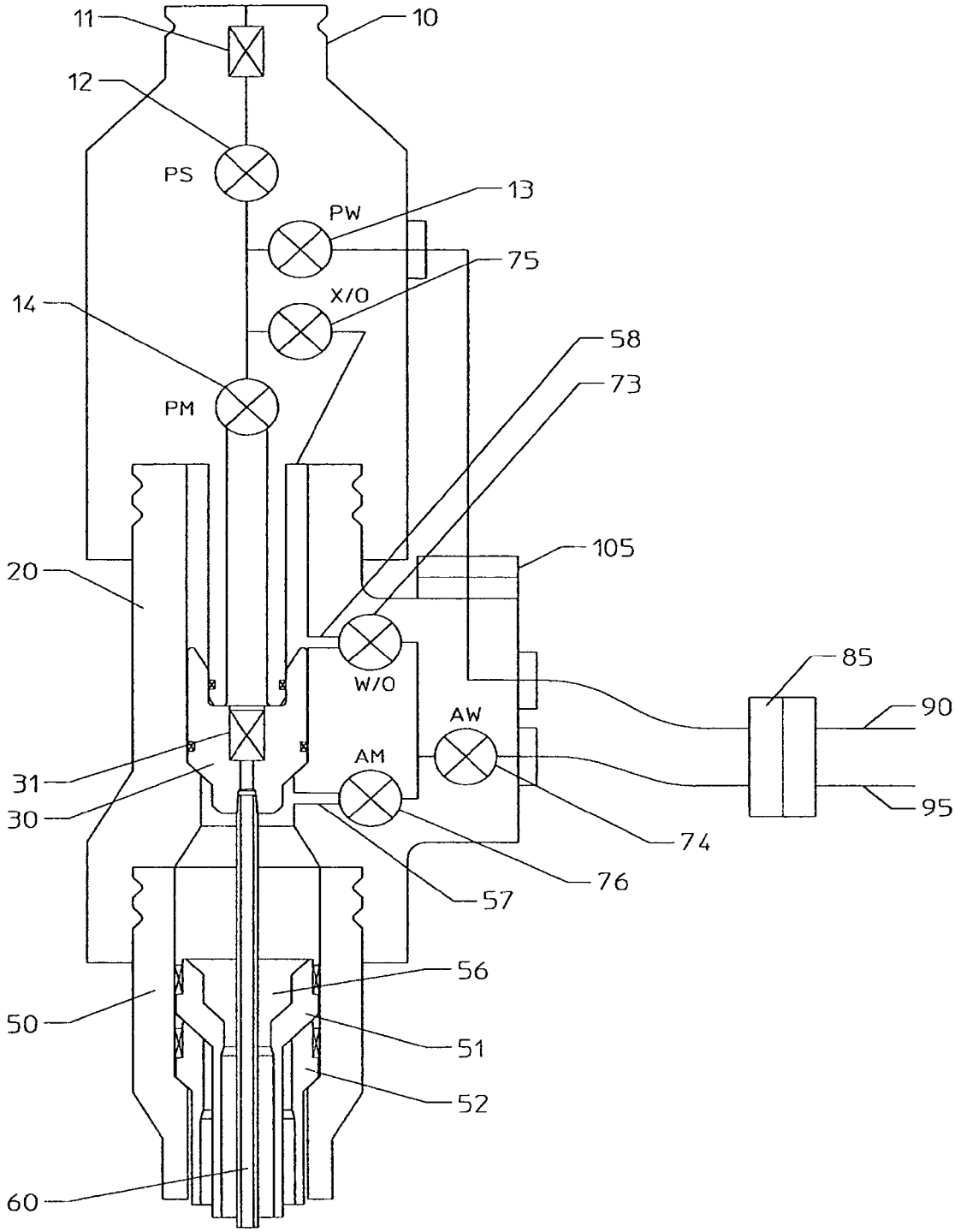
FIG. 3 is an example of a subsea production system having a cross over valve in the production tree according to the present invention.
Figure 4:
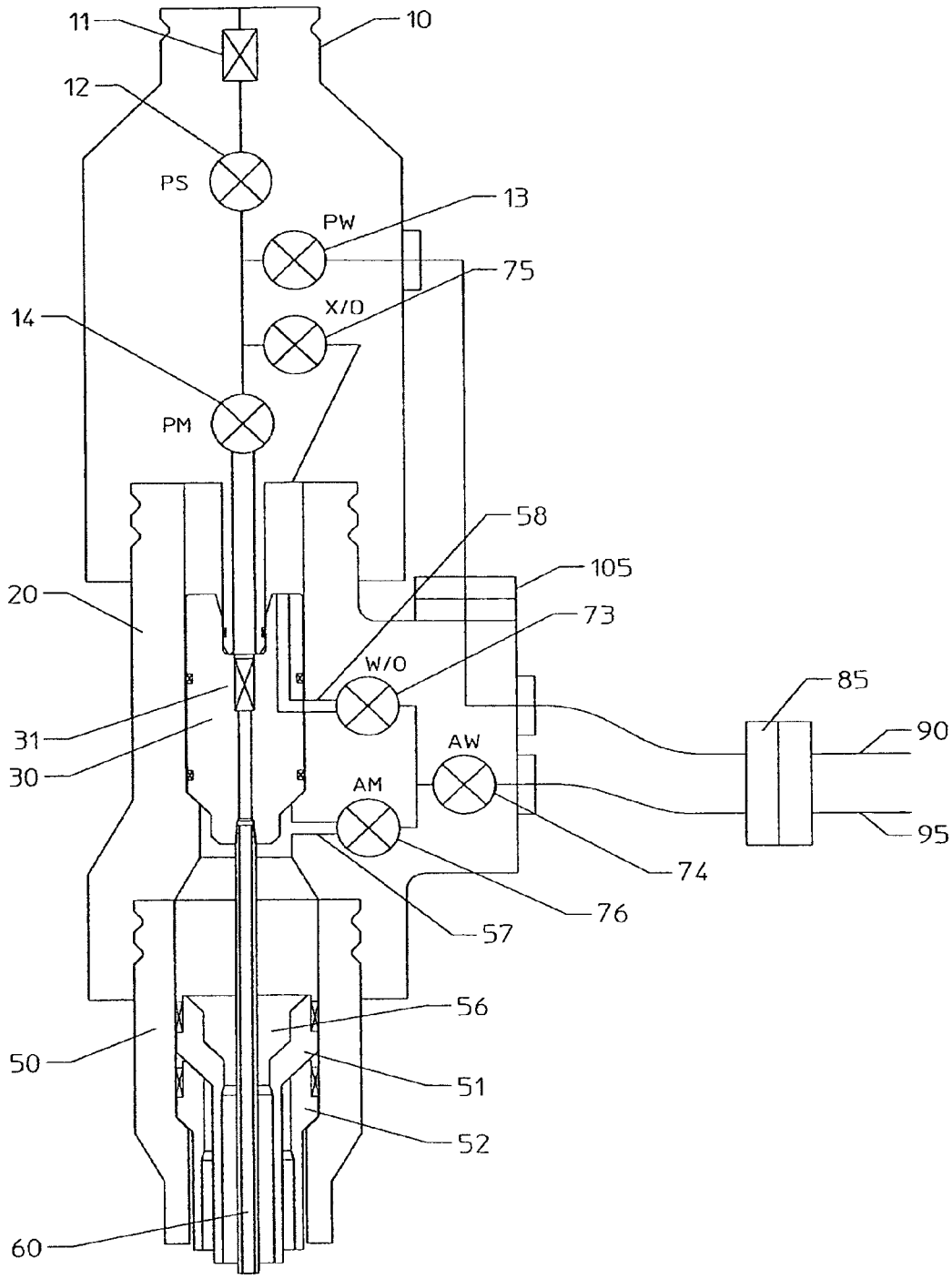
FIG. 4 is another example of a subsea production system having a cross over valve in the production tree according to the present invention.
Figure 5:
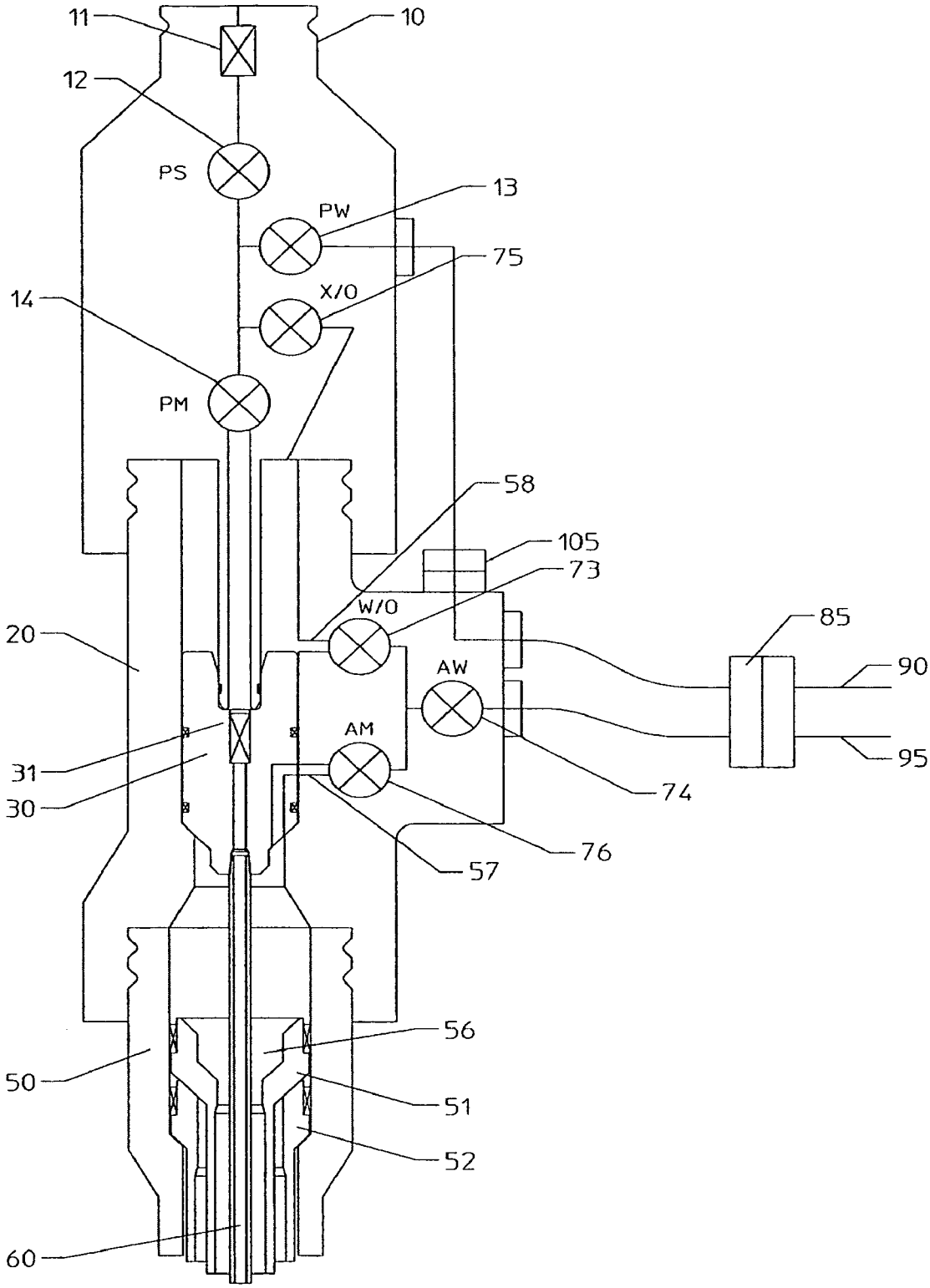
FIG. 5 is another example of a subsea production system having a cross over valve in the production tree according to the present invention.
Figure 6:
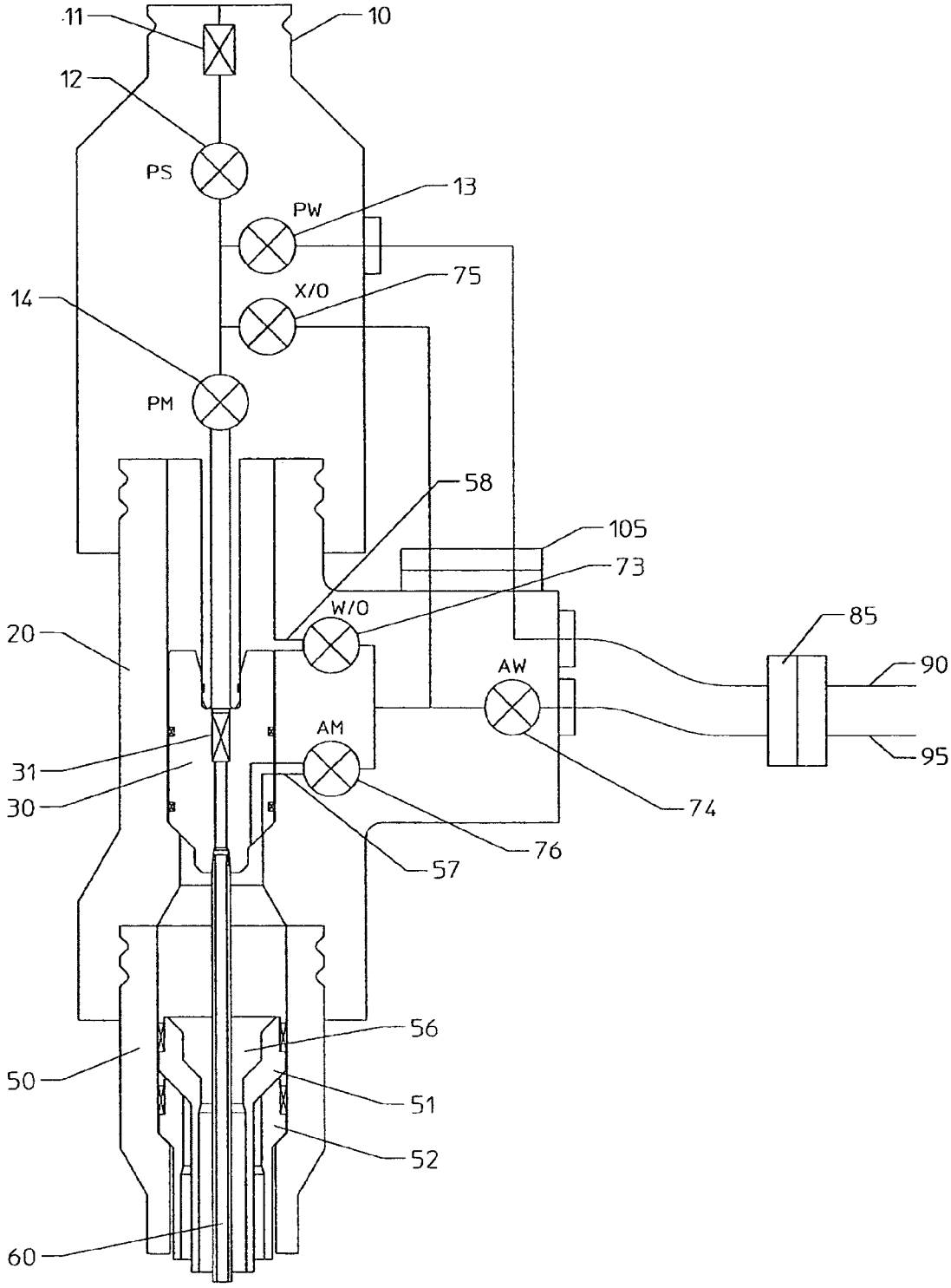
FIG. 6 is another example of a subsea production system having a cross over valve in the production tree according to the present invention.

FIGS. 3-7 depict additional embodiments of the present invention having the cross over valve 75 in the production tree 10. Turning to FIG. 3, spool 20 includes W/O valve 73, AM valve 76, and AW valve 74. Similar to the examples depicted in FIGS. 1 and 2, production fluid flow and annular fluid flow may be controlled by the valves in production tree 10 and spool 20 of the example in FIG. 3. FIG. 4 shows another example subsea production system having a cross over valve 75 in the production tree. In this example, flow path 58 traverses through a portion of the tubing hanger and then to the production tree. Operation of this example occurs in the same fashion as other example implementations. In the example shown in FIG. 5, flow path 57 traverses through at least a portion of tubing hanger 30 and then enters AM valve 76. The embodiment depicted in this example may be operated in fashion similar to the other embodiments. FIG. 6 depicts an embodiment similar to FIG. 5 with the exception that the X/O valve 75 is connected to annulus valves 73, 74, and 76, which are located in the spool.

Figure 7:
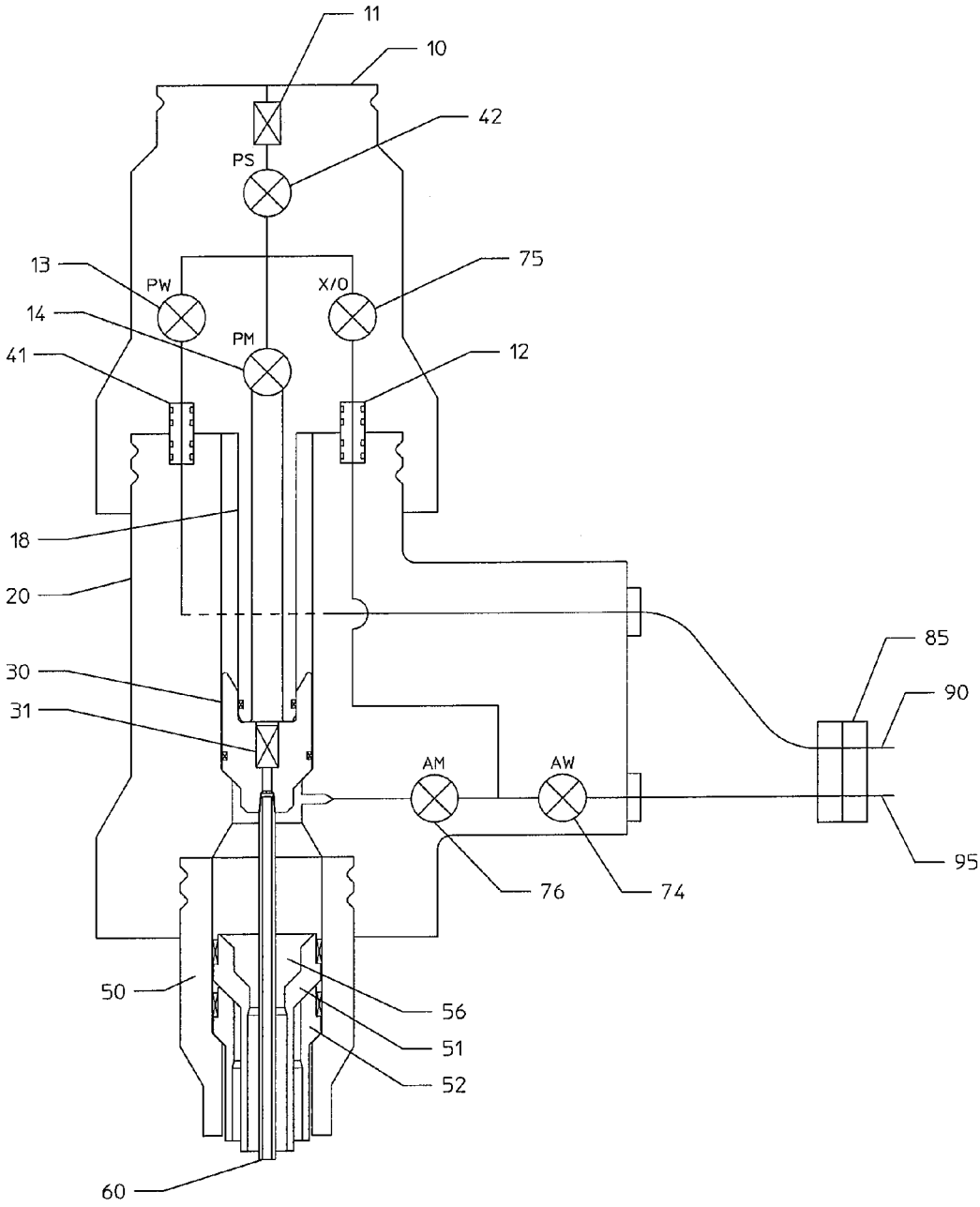
FIG. 7 is another example of a subsea production system having a cross over valve in the production tree according to the present invention.
Figure 8:
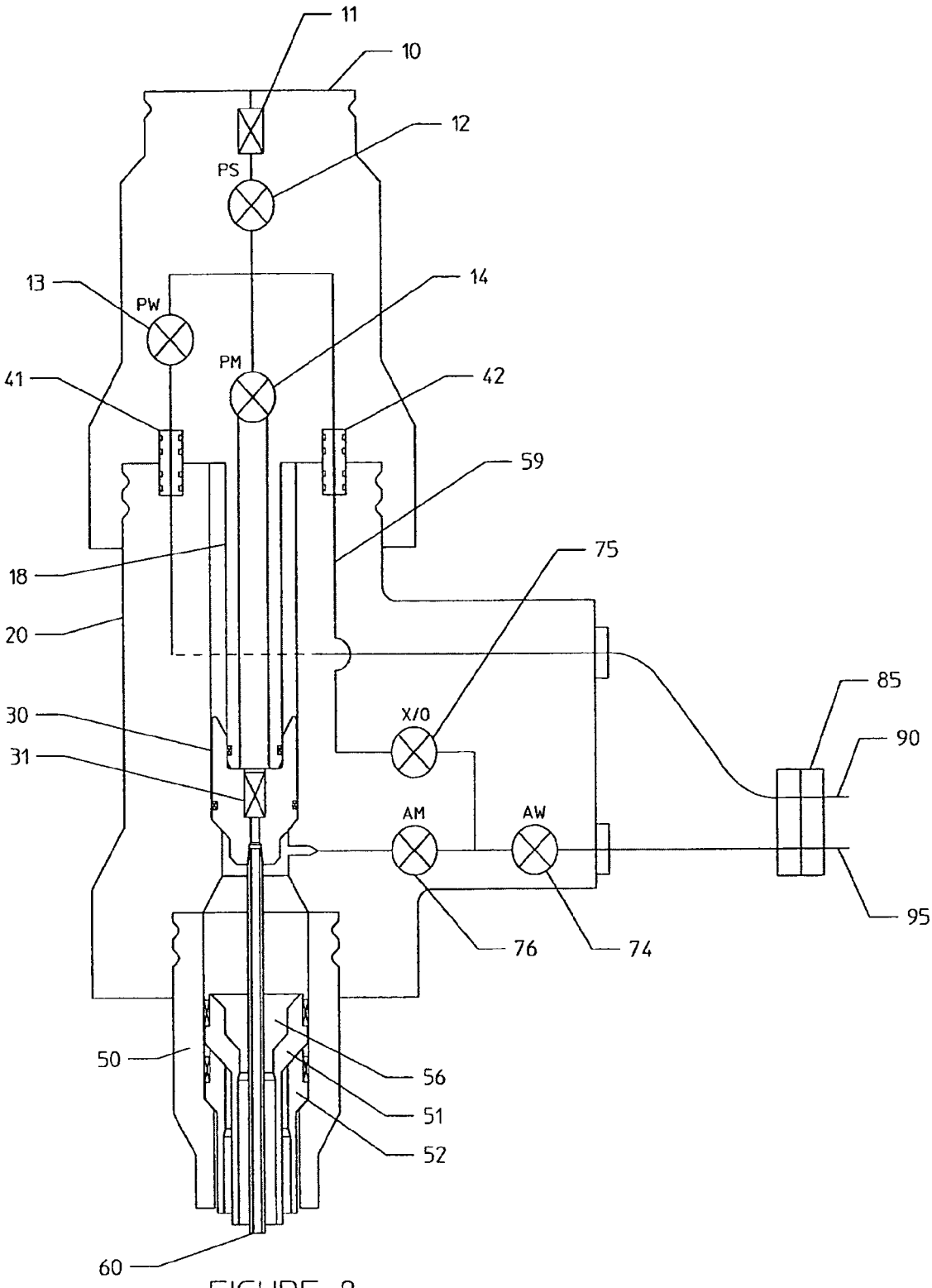
FIG. 8 is another example of a subsea production system having a cross over valve in the tubing spool according to the present invention.

FIG. 7 shows an example subsea production system having a X/O valve 75 in the production tree 10. PW valve 13 is connected to production stab 41. The output of production stab 41 communicates with production flow line 90 through flow line connector 85. X/O valve 75 is connected to AM 76 and AW 74 through annulus stab 42. The example shown in FIG. 7 lacks a W/O valve. In this example, annulus stab 42 and production stab 41 function as valves controlling fluid flow when a BOP adaptor (not shown) is installed on spool 20. In the example shown in FIG. 8, the cross over valve 75 may be moved from within the production tree to within the spool. One skilled in the art with the benefit of this disclosure will recognize that the cross over valve may be placed in various sections of the subsea production system. For example, the systems of FIGS. 7 and 8 may include a multi-bored production tree 10 and spool 20.

Figure 9:
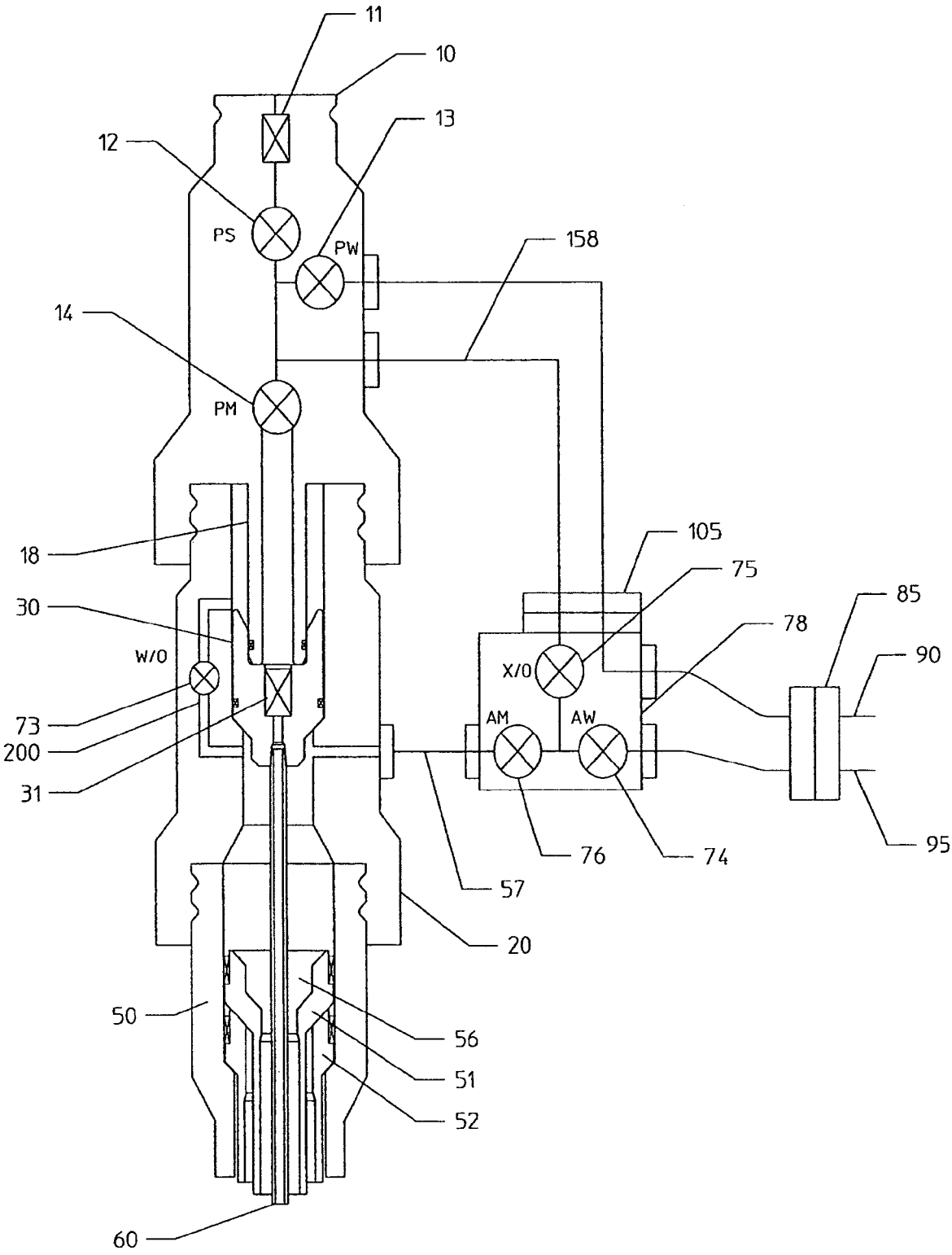
FIG. 9 is another example of a subsea production system having a work over valve in the tubing spool according to the present invention.

In still other embodiments, the work over valve may be placed within the spool. The examples shown in FIGS. 9-12 depict examples having a work over valve 73 located within the spool. The work over valve 73 may provide for a work over path. The work over valve 73 shown in FIG. 9 is part of a bypass flow path 200 that has an upper and a lower end. The lower end of the bypass flow path communicates with the tubing annular region below the tubing hanger, and the upper end of the bypass flow path communicates with the central bore of the tubing spool above the tubing hanger. Also shown in FIG. 9 is a separate annulus block 78. In this example, the circulation of the annular fluid through flow path 200 may be contained within the wall of the spool.

Figure 10:
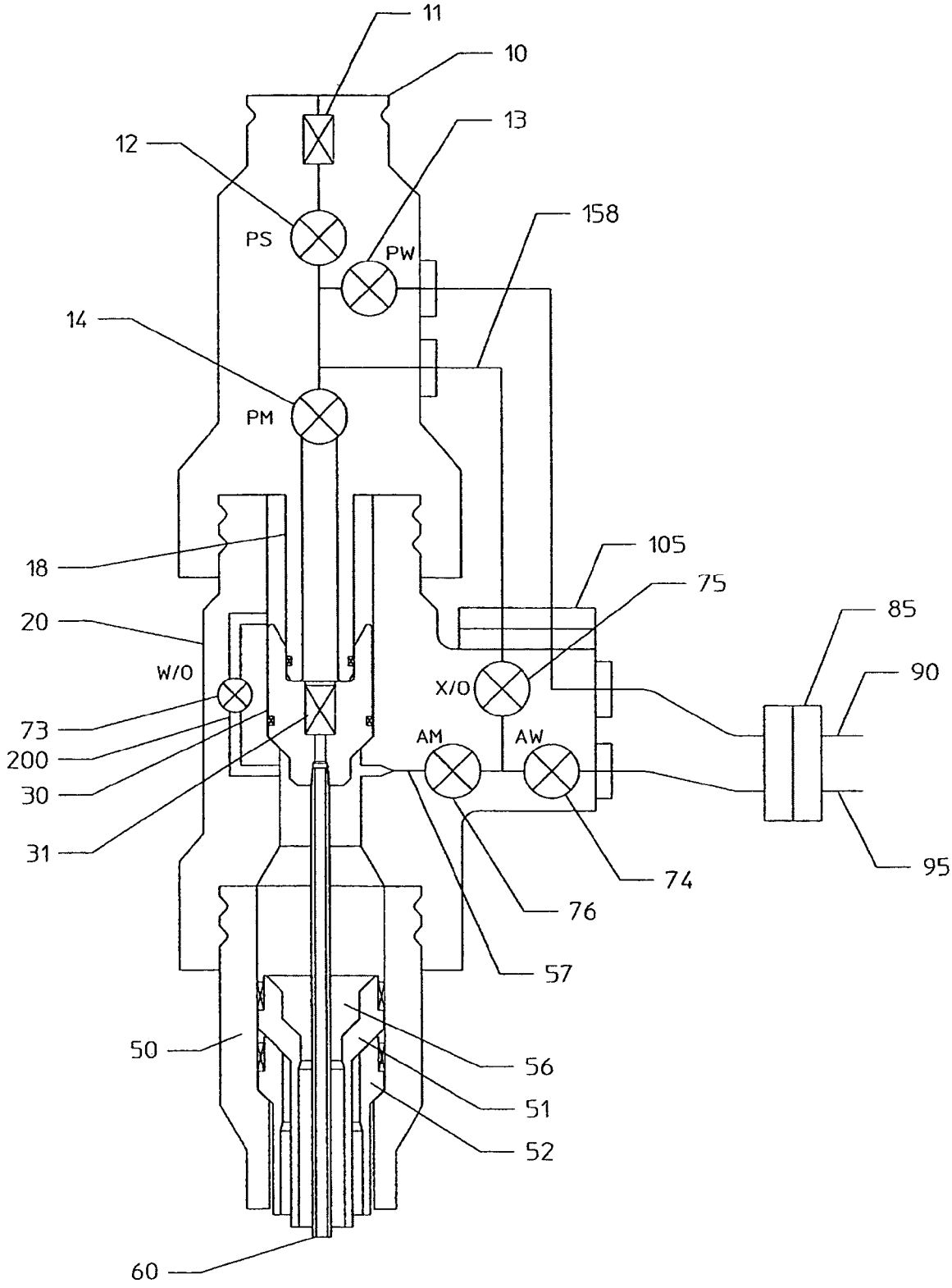
FIG. 10 is another example of a subsea production system having a work over valve in the tubing spool according to the present invention.
Figure 11:
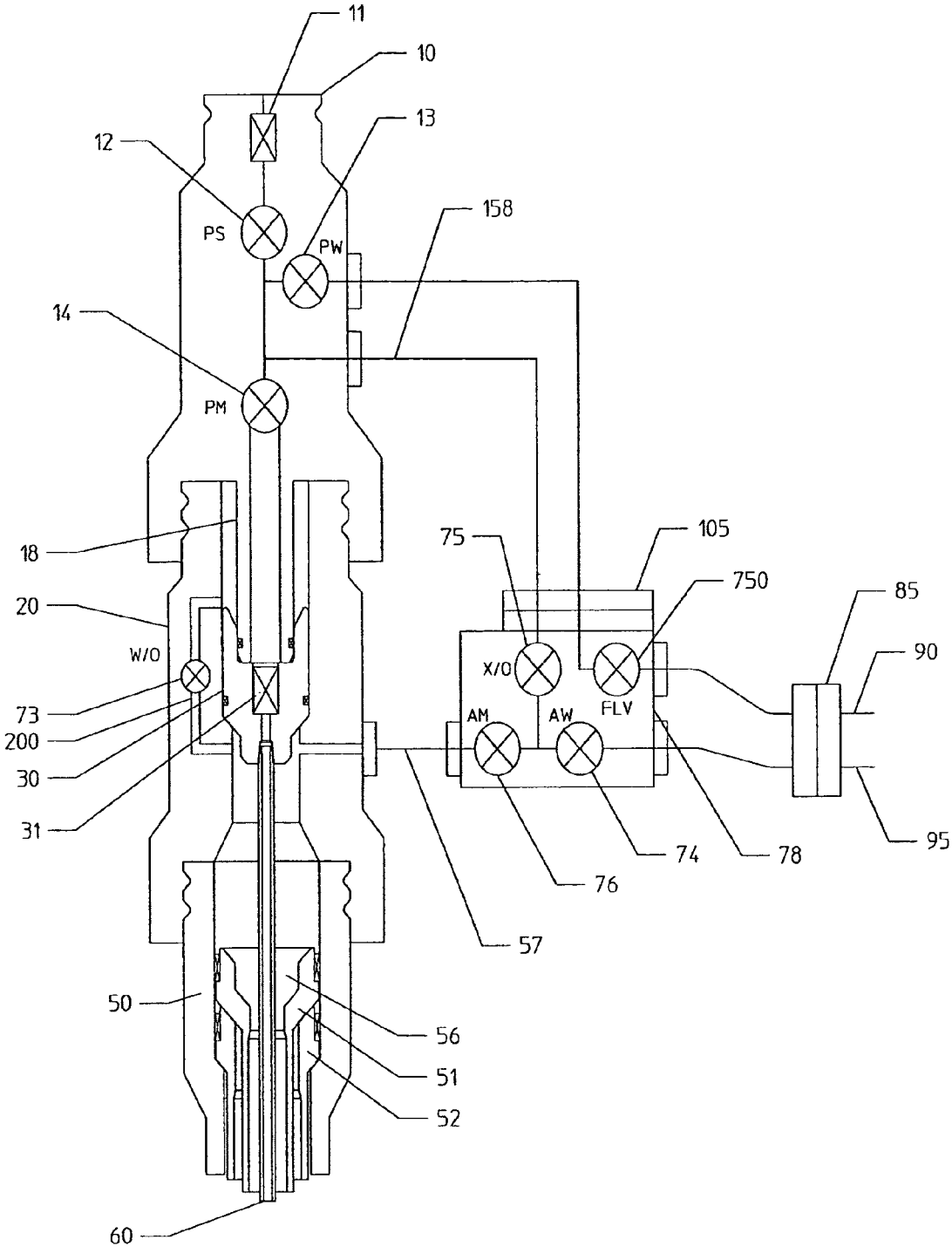
FIG. 11 is another example of a subsea production system having a work over valve in the tubing spool according to the present invention.
Figure 12:
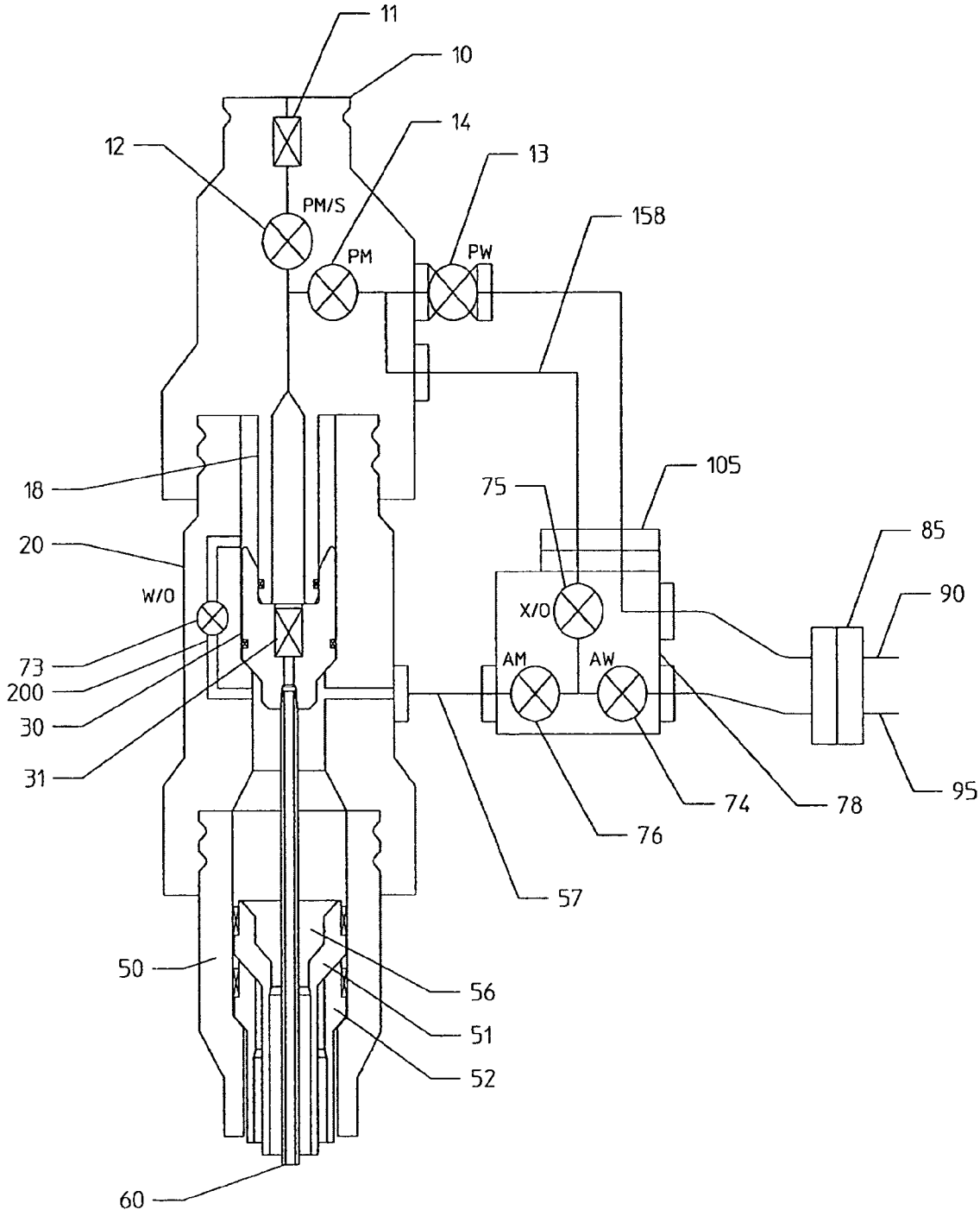
FIG. 12 is another example of a subsea production system having a work over valve in the tubing spool according to the present invention.

FIG. 10 depicts an example subsea system having a work over valve 73 in the spool and having the annulus valves X/O 75, AM 76, and AW 74 integral to spool 20. FIG. 11 depicts an example having a work over valve 73 in the spool and having an separate annulus block 78. The annulus block 78 shown in FIG. 11 also includes a flow valve (FLV) 750 for controlling production flow. FLV 750 may be incorporated into any of the embodiments of the present invention. Closing FLV 750 permits access to the annular fluid through annular flow line 95. For example, FLV 750 may prevent product from flowing back into the system after removal of the production tree. In another example, closing FLV 750 provides for product to flow through X/O valve 75 and out through annular flow line 95. In still another embodiment, PW valve 13 may have a lateral configuration as shown in FIG. 12. In this example, both PW valve 13 and PM valve 14 are not located in the vertical bore of the production tree. One skilled in the art with the benefit of this disclosure will recognize other configurations of subsea production trees.

Figure 13:
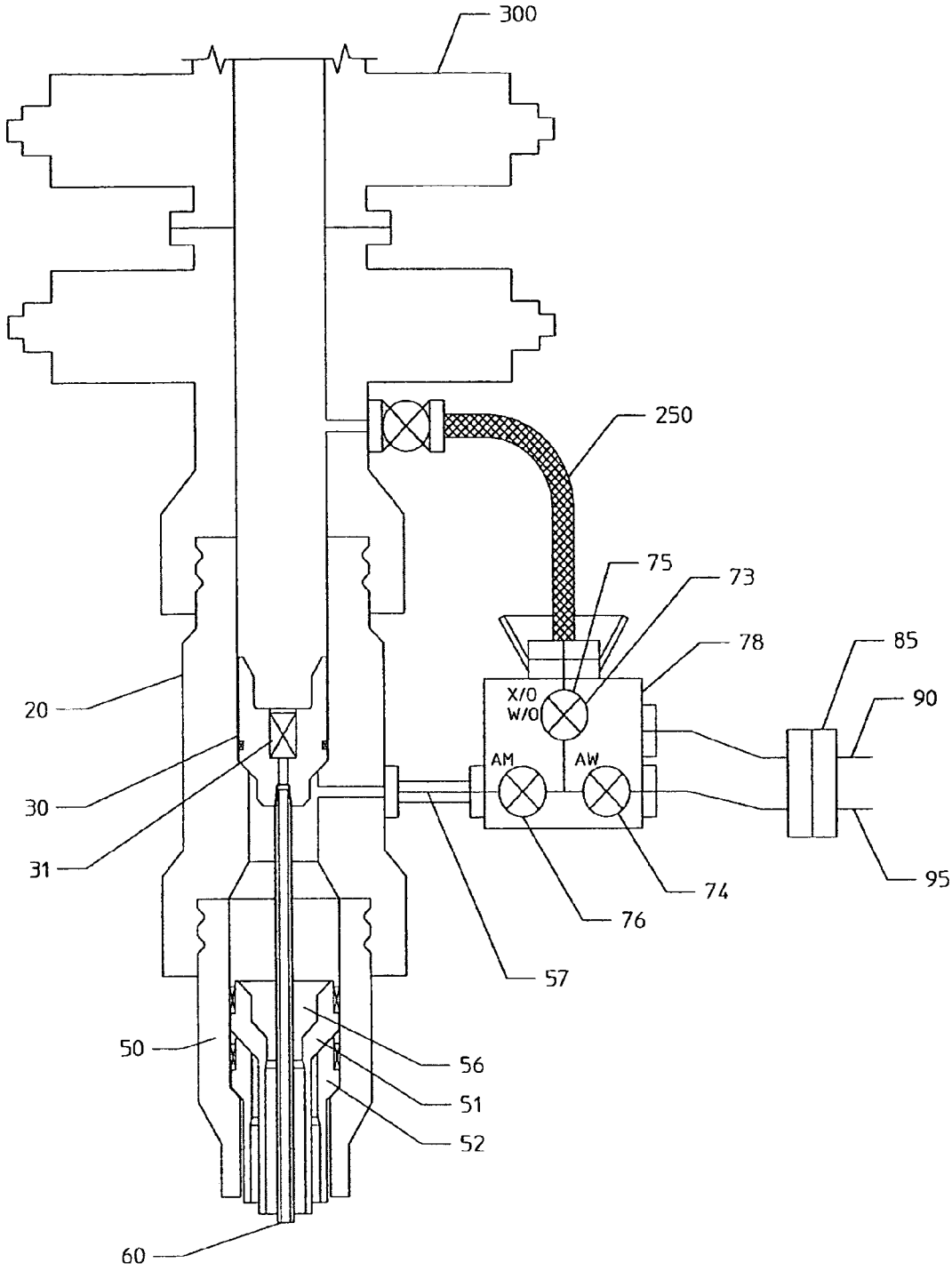
FIG. 13 is an example of a subsea production system having a separate annulus block and a BOP stack jumper according to the present invention.

FIG. 13 shows an example of a subsea production system including a blow out preventer ("BOP") 300. A BOP stack jumper 250 is shown connecting BOP 200 to a separate annulus block 78 for installation and work over. The separate annulus block 78 includes valves W/O 73, AM 76, and AW 74. Shown in FIG. 13 is a bypass flow path providing a pathway for annular flow from below the tubing hanger (flow path 57) to above the tubing hanger (BOP stack jumper 250). In other examples, connections with a riser may be made at one or more locations along the subsea production system.

BOP stacks typically exert large bending loads to points at and below the connection of the BOP to the subsea production system. In one example, a simple and small tree having a low bending capacity connector on the bottom of the tree may be used. In another example, a BOP adapter may be included in the production systems shown in FIGS. 7, 8, 18, and 19. In another example, when needed, a BOP connector is connected to the top of the spool, but not connected to the top of the tree.

Figure 14:
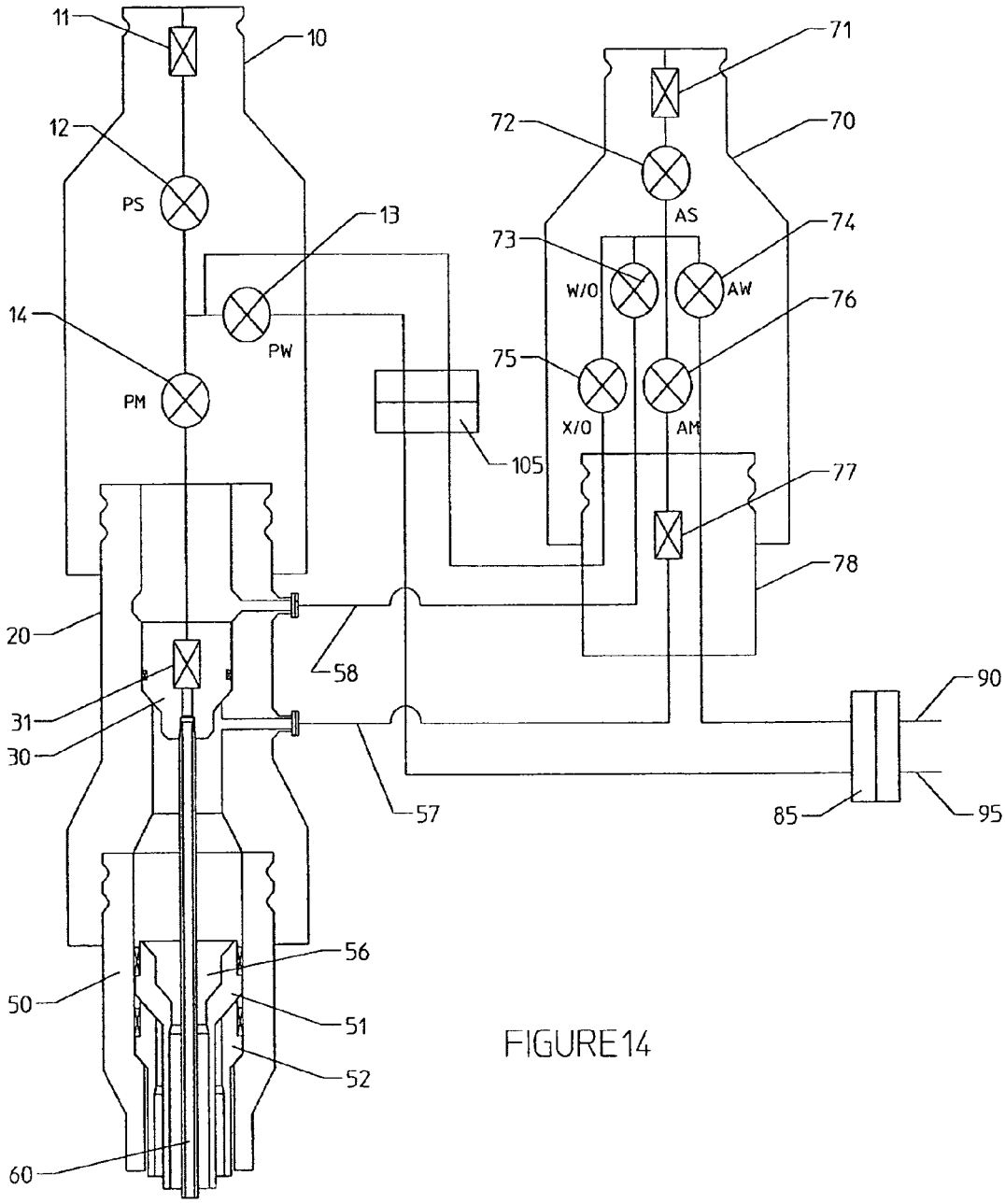
FIG. 14 is another example of a subsea production system having a cross over valve in the annulus tree according to the present invention.
Figure 15:
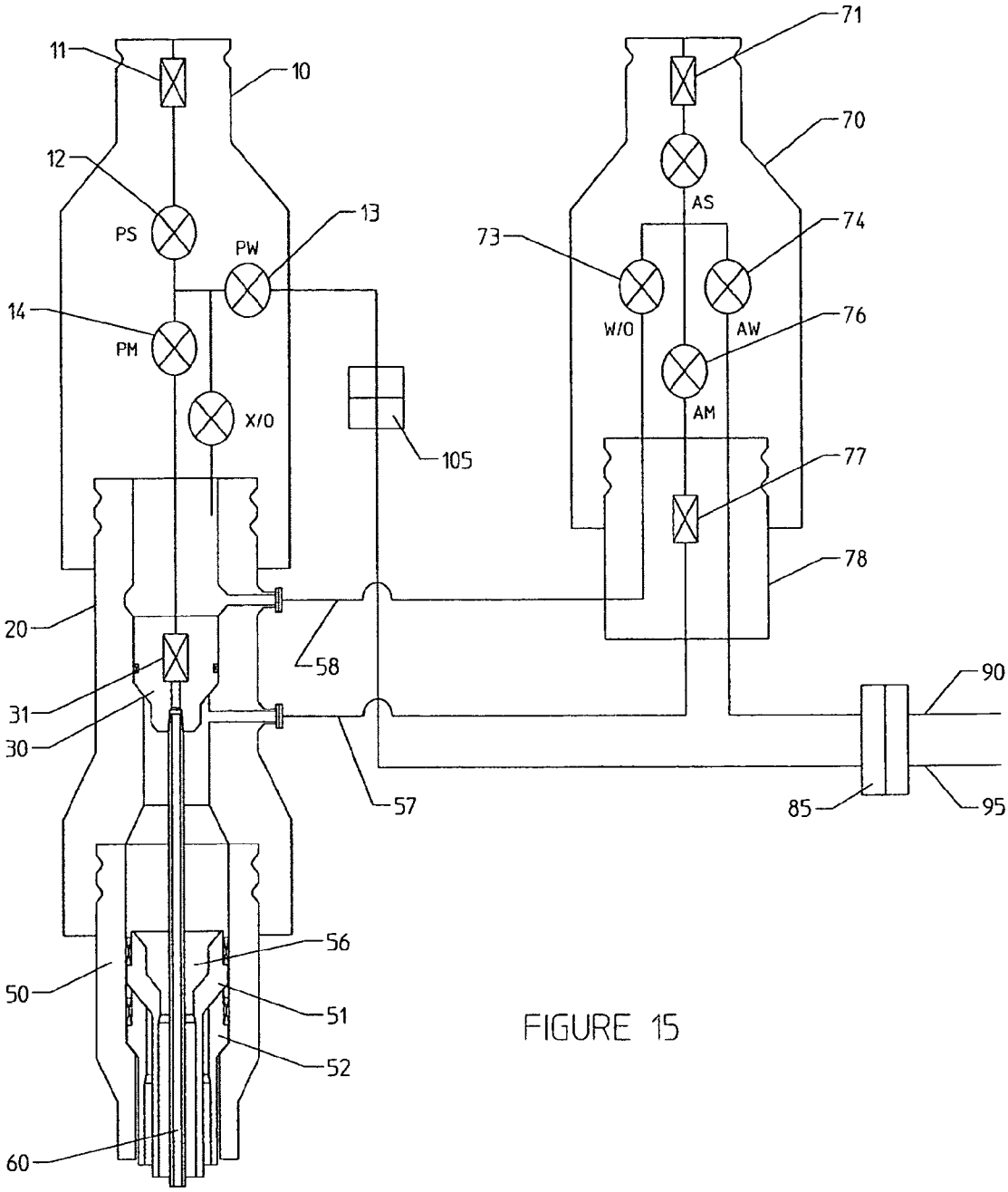
FIG. 15 is another example of a subsea production system having a cross over valve in the production tree according to the present invention.
Figure 16:
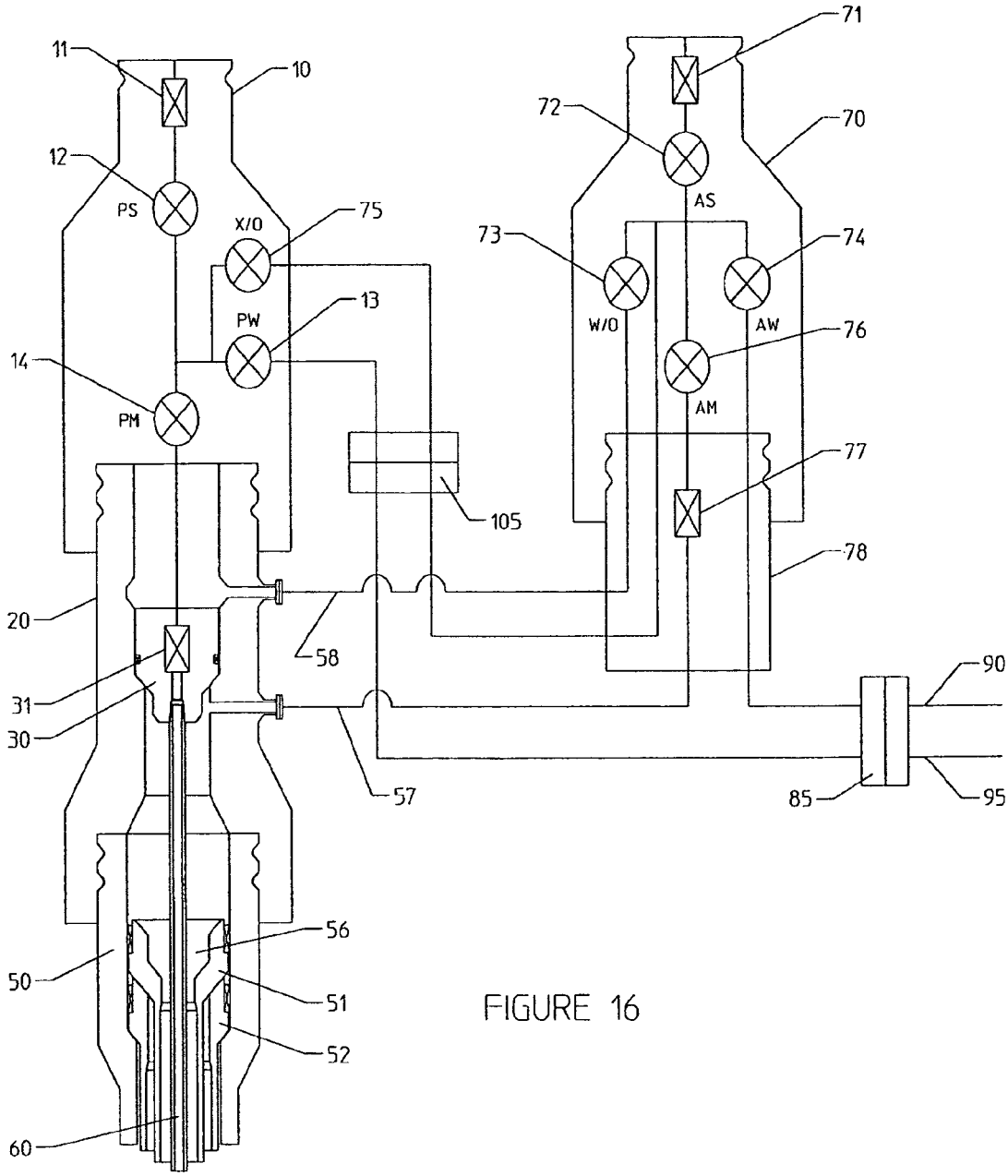
FIG. 16 is another example of a subsea production system having a cross over valve in the production tree according to the present invention.

In still other embodiments, it may be desirable to have an annulus tree that can be removed and retrieved to the surface. FIG. 14 depicts an example of a subsea production system having a retrievable annular block 70. The subsea production system of FIG. 14 includes a production tree 10, a tubing spool 20, a tubing hanger 30, and a wellhead 50. Production tree 10 includes valves PS 12, PW 13, and PM 14, and production tree plug 11. Production tree 10 is connected to annulus tree 70 and annular flow line 95 through jumper connection 105. Annular block 70 includes annulus tree plug 71, valves AS 72, W/O 73, AW 74, X/O 75, and AM 76. Annulus tree is connected to an annulus tree base 78 having an annulus tree plug 77. The annulus tree is part of a bypass flow path that has an upper and a lower end. The lower end of the bypass flow path (flow path 57) communicates with the tubing annular region below the tubing hanger, and the upper end of the bypass flow path (flow path 58) communicates with the central bore of the tubing spool above the tubing hanger.

Figure 17:
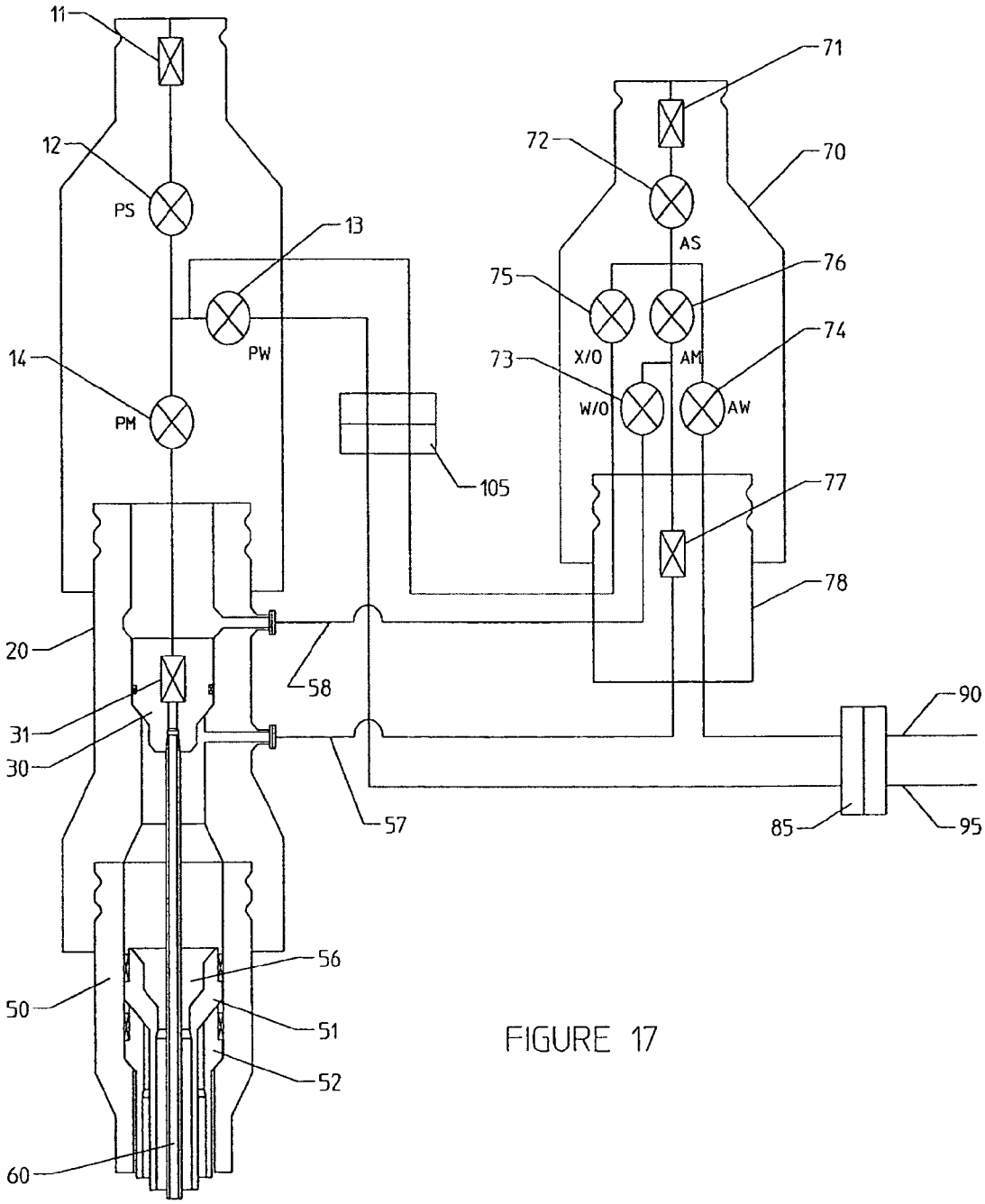
FIG. 17 is another example of a subsea production system having a cross over valve in the annulus tree according to the present invention.

One skilled in the art with the benefit of this disclosure will recognize other configurations of subsea production systems having a retrievable annular tree. Some examples are depicted in FIGS. 15-19. The systems shown in FIGS. 15 and 16 have a cross over valve 75 included in the production tree 10. The cross over valve 75 may also be placed in the annulus tree as shown in FIG. 17.

Figure 18:
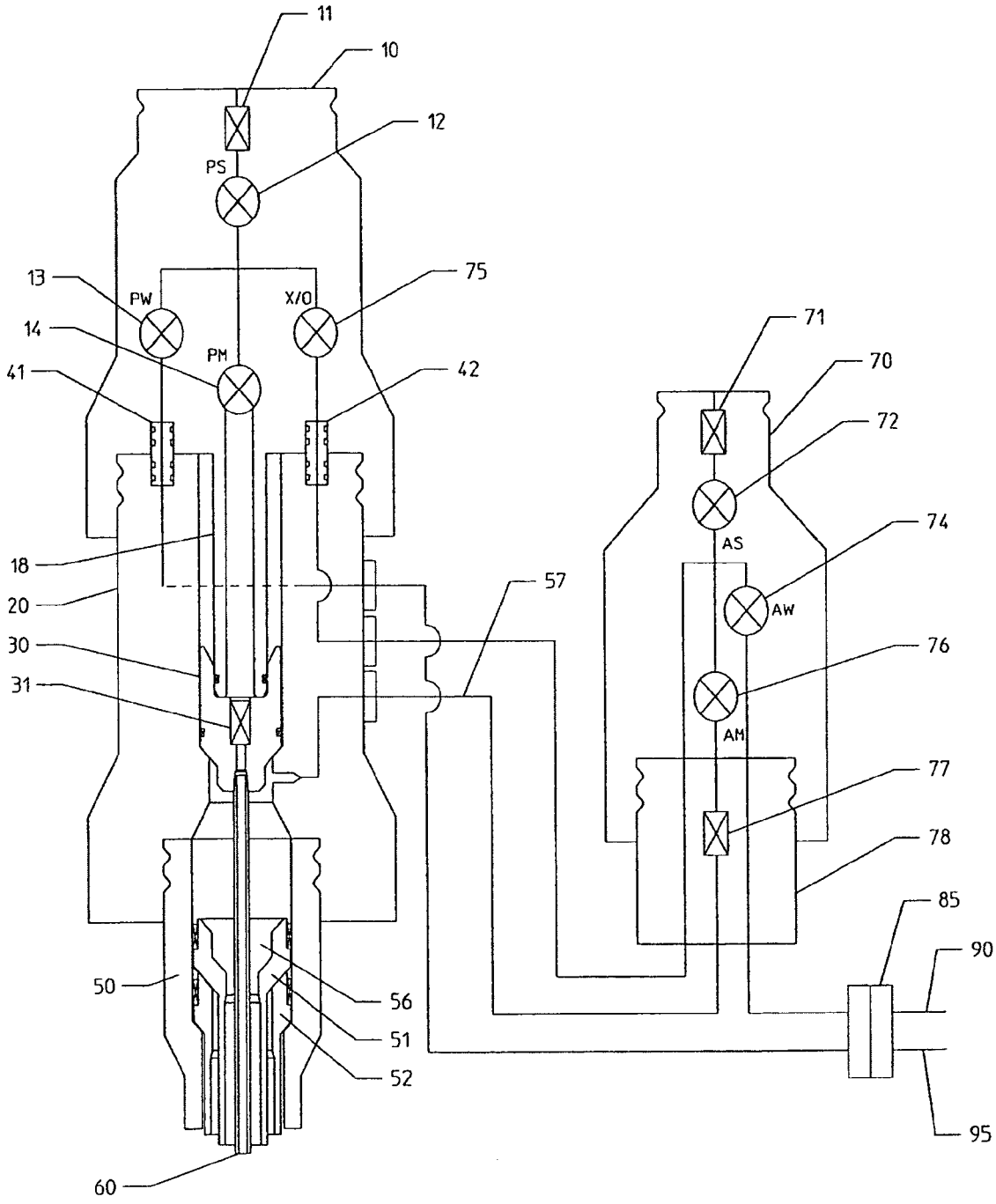
FIG. 18 is another example of a subsea production system having a cross over valve in the production tree according to the present invention.
Figure 19:
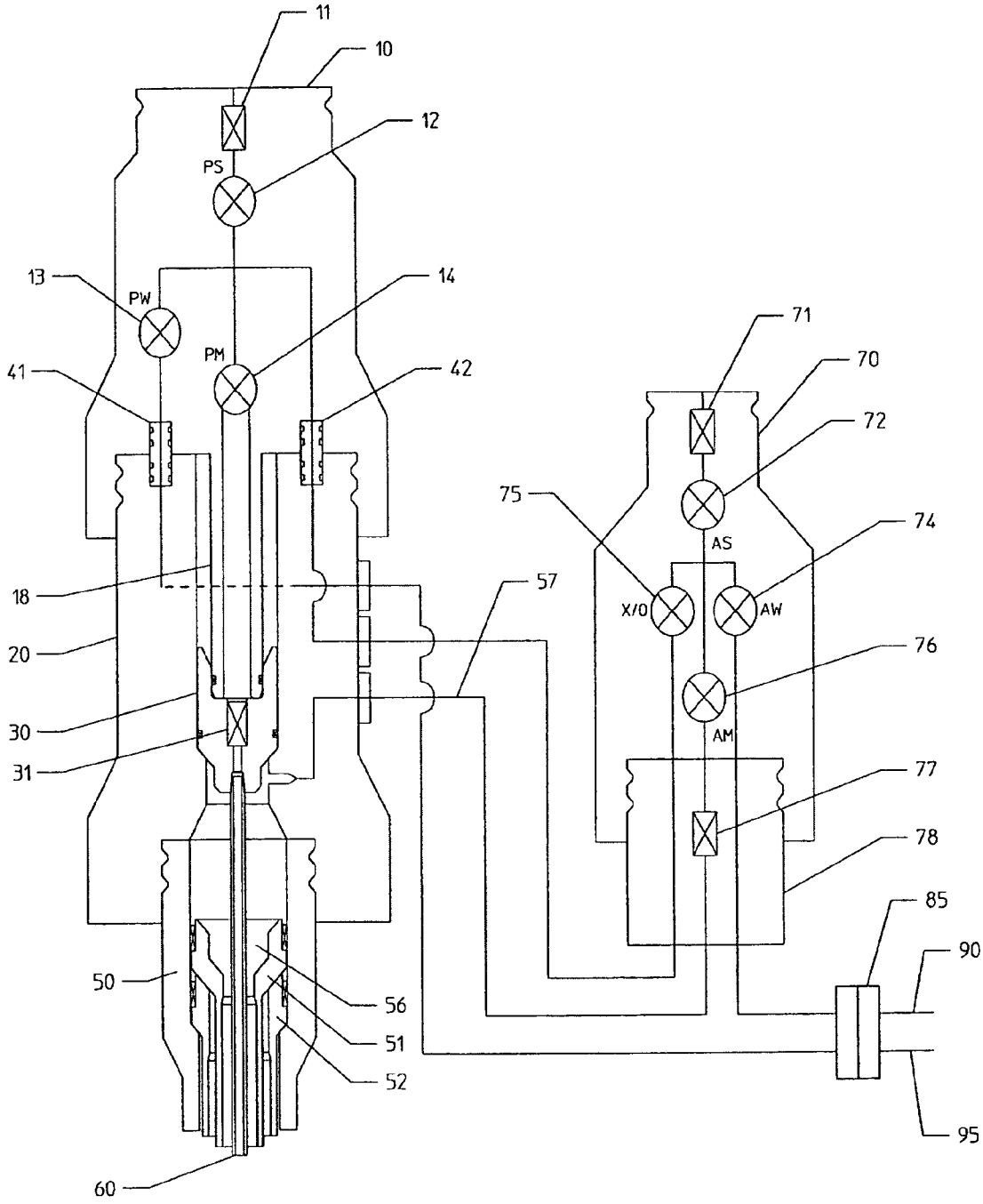
FIG. 19 is another example of a subsea production system having a cross over valve in the annulus tree according to the present invention.

In still other embodiments, a production tree having a cross over valve 75, a production stab 41, and an annular stab 42 may be used with a retrievable annular tree as shown in FIG. 18. One skilled in the art with the benefit of this disclosure will recognize that the cross over valve 75 may be placed in the annulus tree as shown in FIG. 19.

Figure 20:
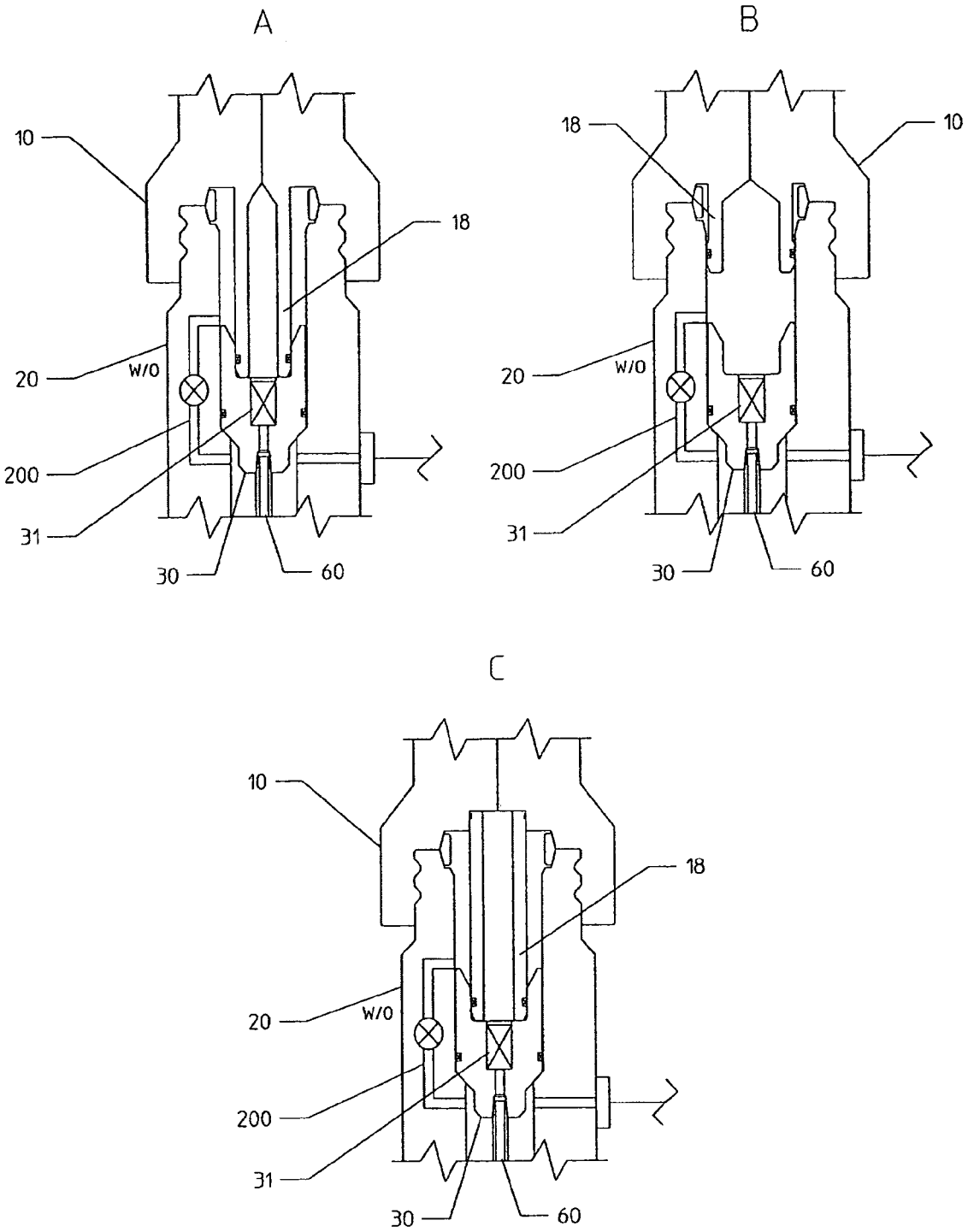
FIG. 20 are example implementations of an isolation seal according to the present invention.

As shown in FIG. 20, the isolation sleeve 18 may be implemented in various embodiments. In the implementation shown in FIG. 20A, isolation sleeve 18 forms a seal with tubing hanger 30. The work over valve 73 shown in FIG. 20A is part of a bypass flow path (flow line 200) permitting annular fluid flow from below the tubing hanger to above the tubing hanger. Also shown in FIG. 20A are the tubing hanger plug 31 and tubing string 60. In the example shown in FIG. 20B, isolation sleeve 18 forms a seal with the top of spool 20. The work over valve 73 shown in FIG. 20B forms a bypass flow path (flow line 200) permitting annular fluid flow from below the tubing hanger to above the tubing hanger. FIG. 20C is an embodiment showing another implementation of attaching isolation sleeve 18 to production tree 10.

Figure 21:
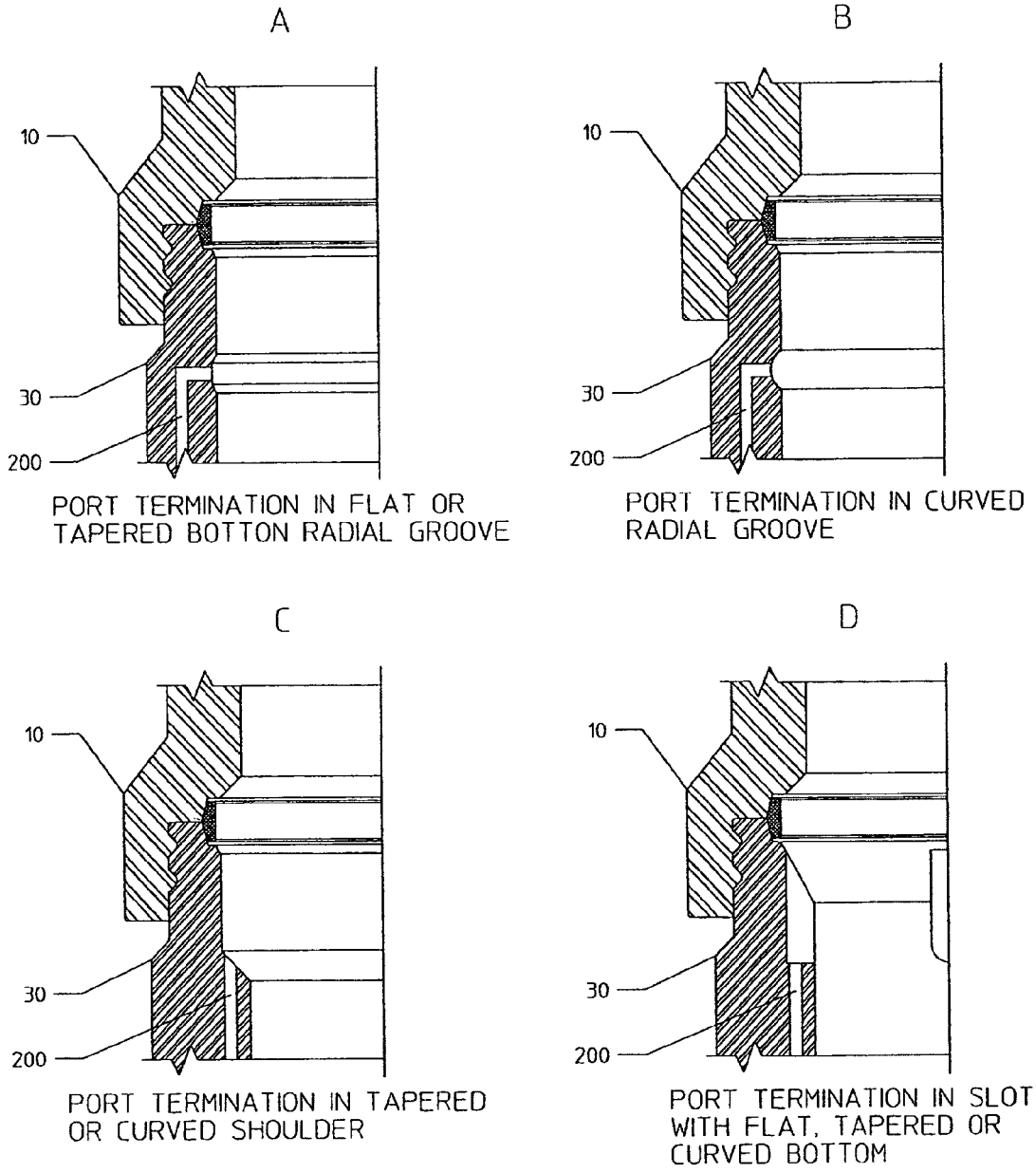
FIG. 21 are example implementations of the port termination of the bypass flow path above the tubing spool according to the present invention.

The termination of flow path 200 at a point above the tubing spool may be implemented in various embodiments. As shown in FIG. 21A, flow path 200 may be terminated in a flat or tapered bottom radial groove. FIG. 21A shows part of production tree 10 and spool 30. FIG. 21B depicts a curved radial groove termination of flow path 200 at a point located above the tubing spool. The port may also be terminated in a tapered or curved shoulder (FIG. 21C) or in a slot with a flat, tapered, or curved bottom (FIG. 21D). One skilled in the art with the benefit of this disclosure will recognize that the bypass fluid pathway may be terminated at a point above the tubing hanger in various embodiments. For example, certain configurations may mitigate debris collection in the flow path.

Figure 22:
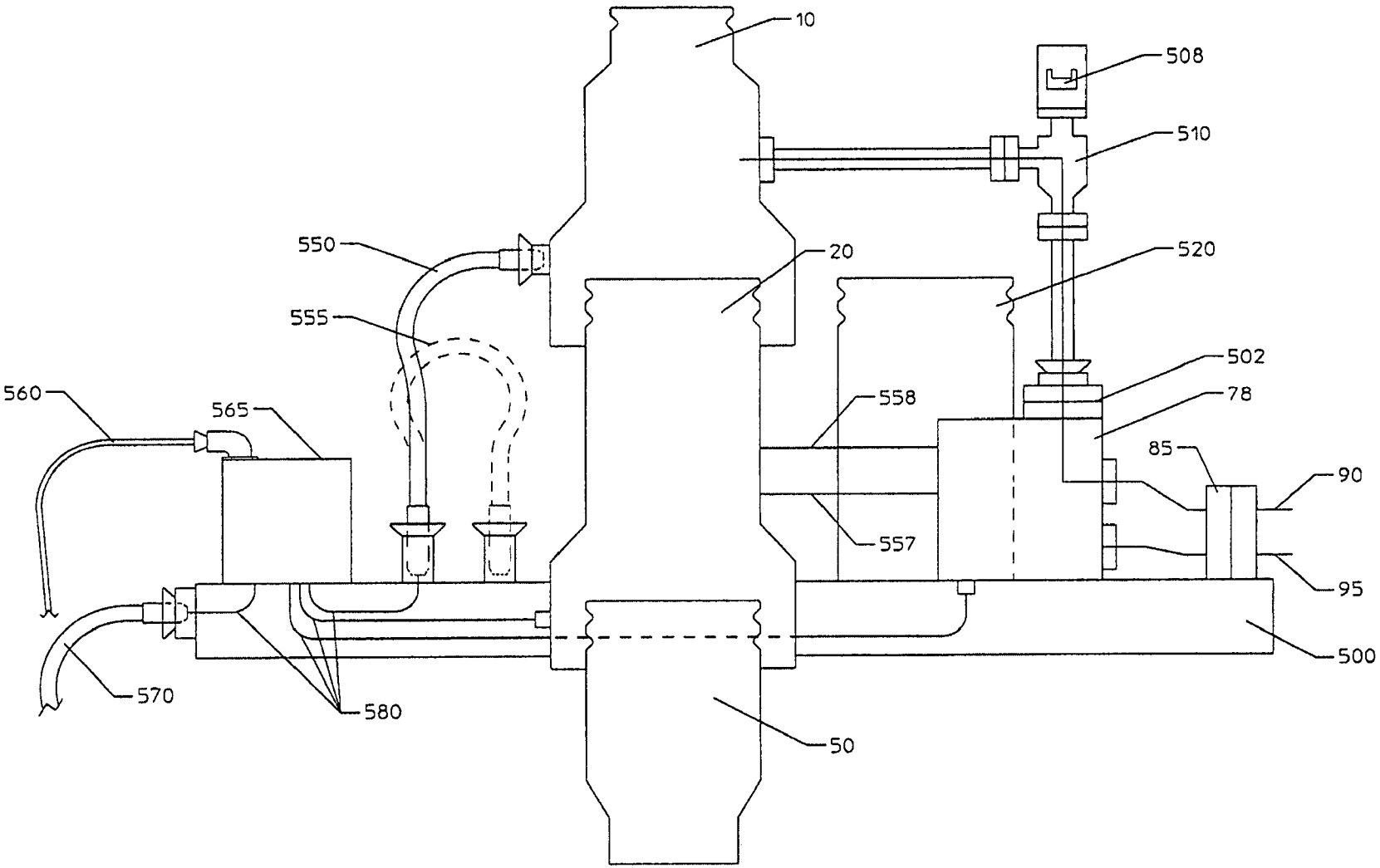
FIG. 22 is an example controls interface for a subsea production system according to the present invention.

One embodiment of a controls interface for a subsea production system is shown in FIG. 22. The control system of FIG. 22 includes a control pod 565, a tree 10, a spool, 20, a wellhead 50, a tree parking stump 520, a choke 510, an annulus block 78, and a base 500 to support the subsea production system. In another example, a parking stump may be located separate from base 500 and may service one or more trees. An electric cable 560 and a hydraulic umbilical 570 are connected to control pod 565. Control conductors 580 are connected to the control pod and provide electrical and/or hydraulic connection to system components. The controls interface also includes an R.O.V. installed electro-hydraulic jumper 550 shown in the installed position. Also shown in FIG. 22 is an R.O.V. installed electro-jumper 555 in the "parked" position. Choke 510 is connected to annulus block 78 through production connector 502. Choke 510 also includes control valve 508. Also coupled to base 500 is flow line connector 85. A production flow line 90 and an annulus flow line 95 are connected to flow line connector 85.

The invention, therefore, is well adapted to carry out the objects and to attain the ends and advantages mentioned, as well as others inherent therein. While the invention has been depicted, described and is defined by reference to exemplary embodiments of the invention, such references do not imply a limitation on the invention, and no such limitation is to be inferred. The invention is capable of considerable modification, alteration and equivalents in form and function, as will occur to those ordinarily skilled in the pertinent arts and having the benefit of this disclosure. For example, some configurations may mitigate debris collection in annular flow path. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A subsea production system, comprising:

a wellhead;

a casing string suspended from the wellhead;

a tubing spool having a central bore connected to the wellhead;

a tubing hanger disposed within the tubing spool and sealed thereto;

an annulus disposed within the casing string, such that access to the annulus is provided through the tubing spool; and a production tree connected to a top of the tubing spool.

2. The subsea production system according to claim 1, further comprising a bypass annulus fluid flow path in fluid communication with the annulus, wherein the bypass annulus fluid flow path passes through an annulus block.

3. The subsea production system according to claim 2, wherein the bypass annulus fluid flow path comprises a first end which is in fluid communication with the annulus and a second end which is in fluid communication with the central bore of the tubing spool above the tubing hanger.

4. The subsea production system according to claim 3, wherein the bypass annulus fluid flow path further comprises an annulus master valve and an annulus wing valve connected in series with the annulus master valve, which control flow into an annular flow line.

5. The subsea production system according to claim 4, wherein the bypass annulus flow path further comprises a cross over valve connected in parallel with the annulus wing valve and which connects to an annular flow line that communicates with a production flow path of the production tree connected to the tubing spool.

6. The subsea production system according to claim 4, wherein the bypass annulus fluid flow path further comprises a cross over valve connected in parallel with the annulus wing valve and which connects to a BOP stack jumper, which in turn communicates with a central bore of a BOP.

7. The subsea production system according to claim 4, wherein the bypass annulus fluid flow path further comprises a work over valve connected in parallel with the annulus wing valve that communicates with a central bore of the tubing spool.

8. The subsea production system according to claim 1 further comprising a bypass annulus fluid flow path in fluid communication with the annulus, wherein the bypass annulus fluid flow path is integrated into the spool.

9. The subsea production system according to claim 8, wherein the bypass annulus fluid flow path comprises a first end which is in fluid communication with the annulus and a second end which is in fluid communication with the central bore of the tubing spool above the tubing hanger.

10. The subsea production system according to claim 9, wherein the bypass annulus fluid flow path further comprises an annulus master valve and an annulus wing valve connected in series with the annulus master valve, which control flow into an annular flow line.

11. The subsea production system according to claim 10, wherein the bypass annulus fluid flow path further comprises a cross over valve connected in parallel with the annulus wing valve and which connects to a flow line that communicates with a production flow path of the production tree connected to the tubing spool.

12. The subsea production system according to claim 11, wherein the bypass annulus fluid flow path further comprises a work over valve connected in parallel with the annulus wing valve that communicates with the central bore of the tubing spool.

13. The subsea production system according to claim 12, wherein the bypass annulus fluid flow path further comprises a cross over valve that connects the central bore of tubing spool to a production flow path of the production tree.

14. The subsea production system according to claim 8, wherein the bypass annulus fluid flow path comprises a first end which is in fluid communication with the annulus and a second end which is in fluid communication with a production flow path of the production tree connected to the tubing spool.

15. The subsea production system according to claim 14, wherein the bypass annulus fluid flow path further comprises an annulus master valve and an annulus wing valve connected in series with the annulus master valve, which control flow into an annular flow line.

16. The subsea production system according to claim 15, further comprising an annulus stab connected in parallel with the annulus wing valve and a cross over valve connected in series with the annulus stab.

17. The subsea production system according to claim 1 further comprising a bypass annulus fluid flow path in fluid communication with the annulus, wherein the bypass annulus fluid flow path passes through an annulus tree.

18. The subsea production system according to claim 17, wherein the bypass annulus fluid flow path comprises a first end which is in fluid communication with the annulus and a second end which is in fluid communication with the central bore of the tubing spool above the tubing hanger and further comprises an annulus master valve and an annulus wing valve connected in series with the annulus master valve, which control flow into an annular flow line.

19. The subsea production system according to claim 18, wherein the bypass annulus fluid flow path further comprises a work over valve connected in parallel with the annulus wing valve which controls flow into the central bore of the tubing spool.

20. The subsea production system according to claim 18, further comprising a work over valve connected in series with the annulus master valve that controls flow into the central bore of the tubing spool and a cross over valve connected in parallel with the annulus master valve, which connects flow to a central bore of a production tree.

21. The subsea production system according to claim 18, further comprising a cross over valve connected in parallel with the annulus wing valve which controls flow into a production flow path of a production tree connected to the tubing spool and which is disposed within the production tree.

22. The subsea production system according to claim 18, further comprising a cross over valve connected in parallel with the annulus wing valve which controls flow into a production flow path of a production tree connected to the tubing spool and which is disposed within the annulus tree.

23. The subsea production system according to claim 19, further comprising an annular fluid line that connects the bypass annulus fluid flow path to a production flow path of a production tree connected to the tubing spool and a cross over valve connected in parallel with the work over valve and disposed within said annular fluid line.

24. The subsea production system according to claim 23, wherein the cross over valve is disposed in the annulus tree.

25. The subsea production system according to claim 23, wherein the cross over valve is disposed in the production tree.

26. The subsea production system according to claim 25, further comprising a flow path connecting the central bore of the tubing spool to the production flow path of the production tree and a cross over valve disposed with the flow path connecting the central bores of the tubing spool and production tree.

27. The subsea production system according to claim 1, further comprising annulus valves for the tubing spool.

28. The subsea production system according to claim 27, wherein the annulus valves are in the spool.

29. The subsea production system according to claim 27, wherein the annulus valves are in an annulus block.

30. The subsea production system according to claim 1, further comprising a bypass annulus fluid flow path integrated into the spool.

31. The subsea production system according to claim 1, further comprising one or more production valves, wherein the production valves are connected to the top of the tubing spool.

* * * * *